US007520585B2

(12) United States Patent
Nagashima

(10) Patent No.: US 7,520,585 B2
(45) Date of Patent: Apr. 21, 2009

(54) LIQUID EJECTION HEAD AND LIQUID EJECTION APPARATUS HAVING MULTIPLE PRESSURE SENSOR MEMBER LAYERS

(75) Inventor: Kanji Nagashima, Kanagawa (JP)

(73) Assignee: Fujifilm Coroporation, Tokyo (JP)

( * ) Notice: Subject to any disclaimer, the term of this patent is extended or adjusted under 35 U.S.C. 154(b) by 437 days.

(21) Appl. No.: 11/391,276

(22) Filed: Mar. 29, 2006

(65) Prior Publication Data

US 2006/0221144 A1 Oct. 5, 2006

(30) Foreign Application Priority Data

Mar. 30, 2005 (JP) ..... 2005-099070
Mar. 31, 2005 (JP) ..... 2005-103131

(51) Int. Cl.
*B41J 29/38* (2006.01)

(52) U.S. Cl. ..... 347/17; 347/68; 347/70

(58) Field of Classification Search ..... 347/9, 347/11, 14, 17, 19, 68–71
See application file for complete search history.

(56) References Cited

U.S. PATENT DOCUMENTS 5,757,392 A 5/1998 Zhang ..... 347/14
6,186,610 B1 2/2001 Kocher et al. ..... 347/11

FOREIGN PATENT DOCUMENTS

JP 5-185590 A 7/1993
JP 7-132592 A 5/1995
JP 11291496 A * 10/1999
JP 2000-94675 A 4/2000

* cited by examiner

*Primary Examiner*—Juanita D Stephens
(74) *Attorney, Agent, or Firm*—Birch, Stewart, Kolasch & Birch, LLP

(57) ABSTRACT

The liquid ejection head has nozzles for ejecting liquid in which a plurality of pressure chambers are arranged in a two-dimensional matrix configuration. The liquid ejection head comprises: pressure generating devices which are disposed so as to correspond to the pressure chambers and generate pressure for ejecting the liquid in the pressure chambers; pressure sensor members formed in at least two layers which determine the pressure inside the pressure chambers generated by the pressure generating devices; and electrodes which are disposed on both surfaces of one of the layers of the pressure sensor members and cause the one of the pressure sensor members to become effective determination sections.

17 Claims, 20 Drawing Sheets

CROSS-TALK SIGNAL FROM ONE PRESSURE CHAMBER

COMBINATION OF CROSS-TALK SIGNALS FROM FOUR PRESSURE CHAMBERS EACH HAVING A PHASE STAGGERED RESPECTIVELY BY 1/2 CYCLE

LIQUID EJECTION HEAD AND LIQUID EJECTION APPARATUS HAVING MULTIPLE PRESSURE SENSOR MEMBER LAYERS

BACKGROUND OF THE INVENTION

1. Field of the Invention

The present invention relates to a liquid ejection head and liquid ejection apparatus, and more particularly, to a liquid ejection head and liquid ejection apparatus comprising a pressure sensor which determines an ejection defect by determining the ink pressure inside a pressure chamber.

2. Description of the Related Art

As an image forming apparatus, an inkjet recording apparatus (inkjet printer) has been known, which comprises an inkjet head (liquid ejection head) having an arrangement of a plurality of nozzles (liquid ejection ports) and forms images on a recording medium by ejecting ink (ink droplets) from the nozzles toward the recording medium while the inkjet head and the recording medium are caused to move relatively to each other.

Various methods are known as the ink ejection methods for an inkjet recording apparatus of this kind. For example, a piezoelectric method is known, in which a diaphragm which constitutes a portion of the pressure chamber is deformed by the deformation of a piezoelectric element (piezoelectric ceramic), and thereby the volume of the pressure chamber is changed. Consequently, ink is introduced into the pressure chambers (ink chambers) from an ink supply passage when the volume of the pressure chambers is increased, and the ink inside the pressure chambers is ejected from the nozzles in the form of ink droplets when the volume of the pressure chambers is decreased.

In an image forming apparatus having an inkjet head, such as an inkjet recording apparatus, ink is supplied to the inkjet head via an ink supply channel from an ink tank which stores ink, and this ink is ejected according to one of the various ejection methods described above or another method. In these cases, it is necessary that ink is ejected stably in such a manner that factors such as the ink ejection volume, the ejection velocity, the ejection direction, and the three-dimensional shape of the ejected ink, is adjusted to uniform values at all times.

However, in order that printing can be performed upon issuing a printing instruction, the nozzles of the inkjet head are filled with ink at all times during printing. If the ink in the nozzles is exposed to the air and the ink in nozzles which do not perform ejection for a long period of time dries, then the viscosity of the ink increases. Hence, it may become difficult to eject ink droplets satisfactorily, and nozzle blockages leading to ejection failures may occur. Furthermore, interruption of the ink supply may occur if there is stagnation of air bubbles introduced into the ink supply channels, or the like, and the delay of ink refilling leading to ejection defects may occur if an ejection operation is continued for a long period of time.

For these various reasons, it is necessary to perform maintenance of the ejection head if an ejection failure has occurred or ink is not stably ejected as described above. If maintenance is carried out frequently, then the recording efficiency declines. Therefore, various ways have been proposed for achieving stable ink ejection and stable image recording.

For example, a method is known in which sensors which determine pressure change occurring in the pressure chambers are provided inside the pressure chambers, and the unintentional emission of satellite ink droplets is suppressed by generating a second pressure wave in accordance with the reflected component of the pressure waves determined by the sensors (see, for example, Japanese Patent Application Publication No. 2000-94675).

Furthermore, for example, a method is also known in which a pressure change determination device for determining the pressure waves inside the pressure chambers is provided, and the intrinsic characteristics of the pressure chambers and a drive voltage waveform for ejecting ink droplets suited to these intrinsic characteristics, are calculated on the basis of the pressure waves determined by the pressure change determination device. By ejecting an ejection liquid on the basis of this drive voltage waveform, a drive waveform which is suited to the characteristics of the pressure waves inside the pressure chambers is always applied to the piezoelectric elements (see, for example, Japanese Patent Application Publication No. 7-132592).

Moreover, for example, a method is known in which pressure sensors for determining the pressure inside the pressure chambers are provided between a diaphragm plate and a pressurization mechanism, the pressure applied to the ink inside the pressure chambers is kept uniform at all times in such a manner that the pressure applied by the pressurization mechanism to the diaphragm plate is uniform in accordance with the output determined by the pressure sensors, and hence the quality of the recorded text characters and images is kept uniform at all times (see, for example, Japanese Patent Application Publication No. 5-185590).

However, in the methods described in the above-described references, pressure sensors for determining the ink pressure inside the pressure chambers is provided inside the pressure chambers respectively. If the pressure chambers and the pressure sensors are arranged one-dimensionally in a single layer, and the pressure chambers and the pressure sensors having this structure are arranged at high density in a two-dimensional matrix, then it is difficult to arrange the wires from the pressure sensors at a high density, and therefore it is difficult to achieve high density arrangement of the pressure chambers.

Furthermore, if the wires are arranged at high density, then problems, such as cross-talk arising between adjacent wires, could be expected.

SUMMARY OF THE INVENTION

The present invention has been contrived in view of the aforementioned circumstances, and an object of the invention is to provide a liquid ejection head in which a pressure chamber, a pressure sensor, and an electrical wire extended from the pressure sensor, are arranged at high density. Another object of the invention is to provide a liquid ejection apparatus in which the occurrence of cross-talk can be suppressed when a pressure chamber, a pressure sensor, and an electrical wire extended from the pressure sensor are arranged at high density.

In order to attain the aforementioned object, the present invention is directed to a liquid ejection head having nozzles for ejecting liquid in which a plurality of pressure chambers are arranged in a two-dimensional matrix configuration, the liquid ejection head comprising: pressure generating devices which are disposed so as to correspond to the pressure chambers and generate pressure for ejecting the liquid in the pressure chambers; pressure sensor members formed in at least two layers which determine the pressure inside the pressure chambers generated by the pressure generating devices; and electrodes which are disposed on both surfaces of one of the layers of the pressure sensor members and cause the one of the pressure sensor members to become effective determination sections.

According to this aspect of the present invention, it is possible to achieve a high-density arrangement of the electrical wires which carry the determination signals from the electrodes that cause the pressure sensor members to act as effective determination sections.

Preferably, the number of the layers of the pressure sensor members is n, where n represents a positive integer; the effective determination sections of one of the pressure sensor members are provided at every (n−1) positions, in respect of at least one of rows and columns of the pressure chambers arranged in a two-dimensional matrix configuration; and electrical wires extended from the electrodes of the effective determination sections are arranged in at least one part of regions where the effective determination sections are not provided.

According to this aspect, it is possible to achieve even higher density of the electrical wires from the electrodes which cause the pressure sensor members to act as the effective determination sections. Furthermore, the manufacturing process may also become easier.

Preferably, sensitivity of the pressure sensor member which is relatively distant from the pressure chambers is greater than sensitivity of the pressure sensor member which is relatively near to the pressure chambers.

According to this aspect, it is possible to achieve uniform sensitivity of the pressure sensor members of the layers, from the viewpoint of the side of the determination circuit.

Preferably, thickness of the pressure sensor member which is relatively distant from the pressure chambers is greater than thickness of the pressure sensor member which is relatively near to the pressure chambers.

According to this aspect, it is possible to use the same material for the pressure sensor members of the layers, and hence the manufacturing process may become easier.

Preferably, a g-constant of the pressure sensor member which is relatively distant from the pressure chambers is greater than a g-constant of the pressure sensor member which is relatively near to the pressure chambers.

According to this aspect, it is possible to design the pressure sensor members to have uniform film thickness in the layers, and hence the manufacturing process may become easier.

Preferably, thickness of close regions of the pressure sensor member relatively near to the pressure chambers which correspond to the effective determination sections of the pressure sensor member relatively distant from the pressure chambers, is smaller than thickness of a periphery of the close regions of the pressure sensor member relatively near to the pressure chambers.

Preferably, close regions of the pressure sensor member relatively near to the pressure chambers which correspond to the effective determination sections of the pressure sensor member relatively distant from the pressure chambers, are vacant.

According to these aspects, it is possible to reduce the effects received by the pressure sensor member of the lower layer from the pressure sensor member of the upper layer.

Preferably, the pressure sensor members are made of piezoelectric material; and electrode surface area of the pressure sensor member which is relatively distant from the pressure chambers is greater than electrode surface area of the pressure sensor member which is relatively near to the pressure chambers.

According to this aspect, it is possible to use the same material for the pressure sensor members of the layers, uniform film thickness can be achieved, and thereby favorable manufacturing characteristics can be ensured.

Preferably, in the pressure sensor member which is relatively near to the pressure chambers, the effective determination sections are arranged at relatively high density on a side relatively distant from a position where a wire is extended to an outside, and the effective determination sections are arranged at relatively low density on a side relatively near to the position where the wire is extended to the outside.

Preferably, in the pressure sensor member which is relatively distant from the pressure chambers, density of the effective determination sections on a side relatively distant from a position where a wire is extended outward is smaller than density of the effective determination sections on a side relatively near to the position where the wire is extended outward.

Accordingly, by possibly disposing the effective determination sections corresponding to the pressure chambers in the layer nearer to the pressure chambers in consideration of the wiring density, rather than dividing the effective determination sections equally between the layer nearer to the pressure chambers and the layer further from the pressure chambers, it is possible to increase the number of the effective determination sections in the layer nearer to the pressure chambers where the sensor characteristics are favorable, and hence the sensitivity of pressure determination can be improved.

In order to attain the aforementioned object, the present invention is also directed to a liquid ejection apparatus having a liquid ejection head having nozzles for ejecting liquid in which a plurality of pressure chambers are arranged in a two-dimensional matrix configuration, the liquid ejection head comprising: pressure generating devices which are disposed so as to correspond to the pressure chambers and generate pressure for ejecting the liquid in the pressure chambers; pressure sensor members formed in at least two layers which determine the pressure inside the pressure chambers generated by the pressure generating devices; and electrodes which are disposed on both surfaces of one of the layers of the pressure sensor members and cause the one of the pressure sensor members to become effective determination sections.

According to this aspect, it is possible to achieve a high-density arrangement of the electrical wires which carry the determination signals from the electrodes that cause the pressure sensor members to act as the effective determination sections.

Preferably, the number of the layers of the pressure sensor members is n, where n represents a positive integer; the effective determination sections of one of the pressure sensor members are provided at every (n−1) positions, in respect of at least one of rows and columns of the pressure chambers arranged in a two-dimensional matrix configuration; and electrical wires extended from the electrodes of the effective determination sections are arranged in at least one part of regions where the effective determination sections are not provided.

According to this aspect of the present invention, it is possible to achieve even higher density of the electrical wires from the electrodes which cause the pressure sensor members to act as the effective determination sections, and the manufacturing process may also become easier.

Preferably, the liquid ejection apparatus further comprises a difference signal calculation device which gets a difference between signals from a positive electrode and a negative electrode of the electrodes through electrical wires, wherein the difference signal calculation device obtains the difference according to at least any one of the following (i) to (iii): (i) an amplification rate of the signal from the positive electrode is made to be different from an amplification rate of the signal from the negative electrode; (ii) the signal from the electrode relatively near to the pressure chambers is temporally delayed; and (iii) width of the electrical wires is altered in accordance with its position in a depth direction.

According to this aspect, it is possible to prevent cross-talk in the voltage signals between the layers of the pressure sensor members which are composed in multiple layers.

Preferably, the liquid ejection apparatus further comprises a determination timing adjustment device which staggers determination timings in such a manner that determination of the pressure is not carried out simultaneously with respect to columns of the pressure sensor members, the columns being mutually adjacent in a direction in which electrical wires are extended from the electrodes of the pressure sensor members.

Preferably, the determination timing adjustment device staggers the determination timings of the pressure sensor members arranged in the direction of the electrical wires, by ½ of a resonance cycle of the pressure chambers.

Preferably, the liquid ejection apparatus further comprises a signal correction device which: measures or logically calculates a correlation between a signal determined by the pressure sensor member which applies cross-talk, and a cross-talk signal by the pressure sensor member which receives the cross-talk; and corrects a signal based on the pressure sensor members according to the cross-talk signal by the pressure sensor member which receives the cross-talk, in determining pressure determination.

According to these aspects, it is possible to prevent cross-talk in the voltage signals between the layers.

Preferably, the liquid ejection apparatus further comprises an electrical shielding layer provided between the layers of the pressure sensor members.

According to this aspect, it is possible to suppress the effects of cross-talk.

As described above, according to the liquid ejection head relating to the present invention, it is possible to achieve a high-density arrangement of the electrical wires which carry determination signals from the pressure sensors.

Furthermore, according to the liquid ejection apparatus relating to the present invention, it is possible to achieve even higher density of the electrical wires from the electrodes which cause the pressure sensor members to act as the effective determination sections, and the manufacturing process also becomes easier. Furthermore, if a difference signal calculation device is provided to get the difference between the signals from the positive and negative electrodes of the electrical wires which transmit a determination signal from a pressure sensor member, then it is possible to prevent cross-talk in the voltage signals between the layers of the pressure sensor members which are composed in multiple layers.

BRIEF DESCRIPTION OF THE DRAWINGS

The nature of this invention, as well as other objects and benefits thereof, is explained in the following with reference to the accompanying drawings wherein.

DETAILED DESCRIPTION OF THE PREFERRED EMBODIMENTS

Figure 1:
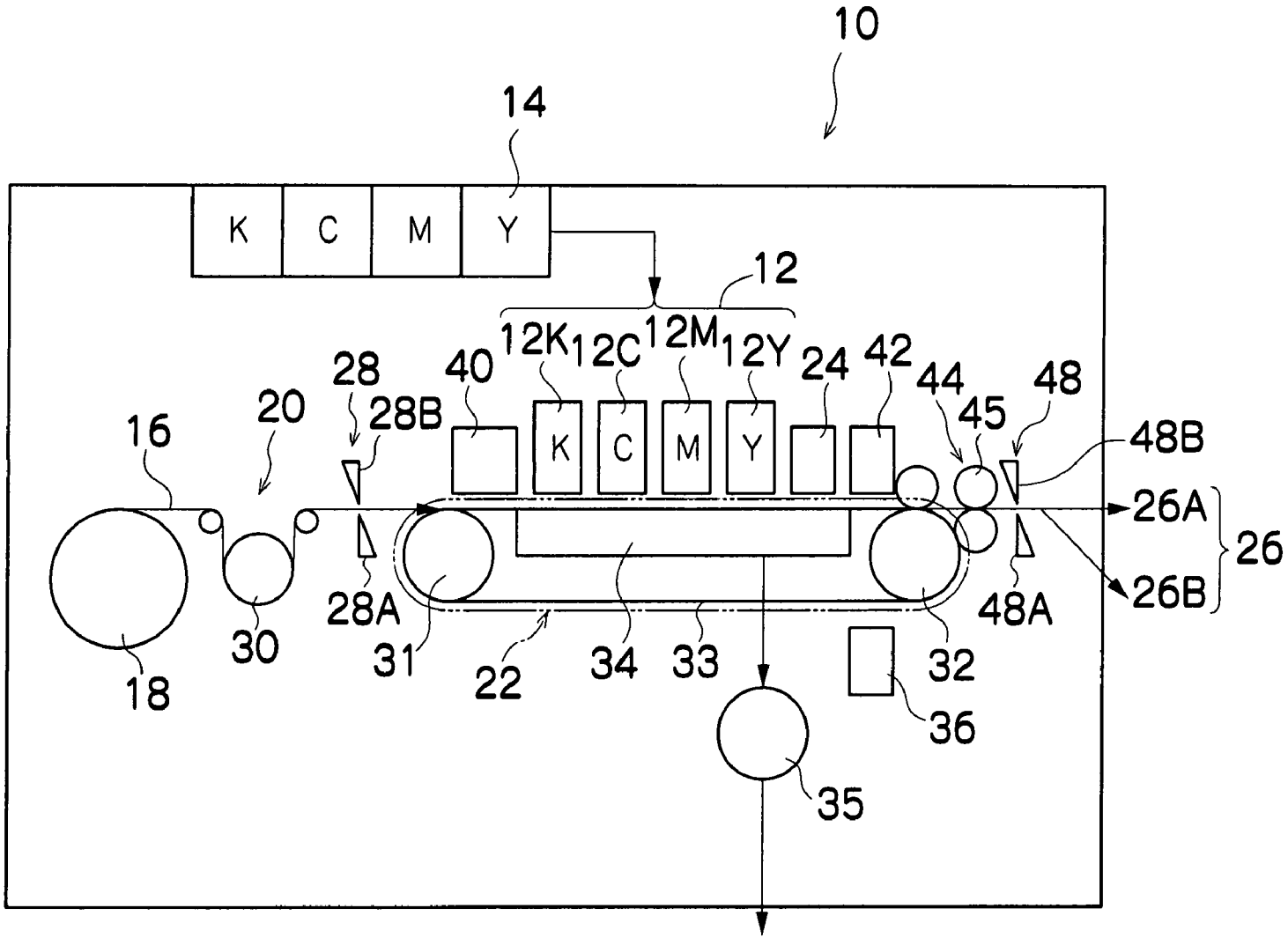
FIG. 1 is a general schematic drawing showing an approximate view of one embodiment of an inkjet recording apparatus having a liquid ejection head (print head) according to the present invention.

FIG. 1 is a general schematic drawing showing an approximate view of a first embodiment of an inkjet recording apparatus forming an image forming apparatus comprising a liquid ejection apparatus having a liquid ejection head relating to the present invention.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different from that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
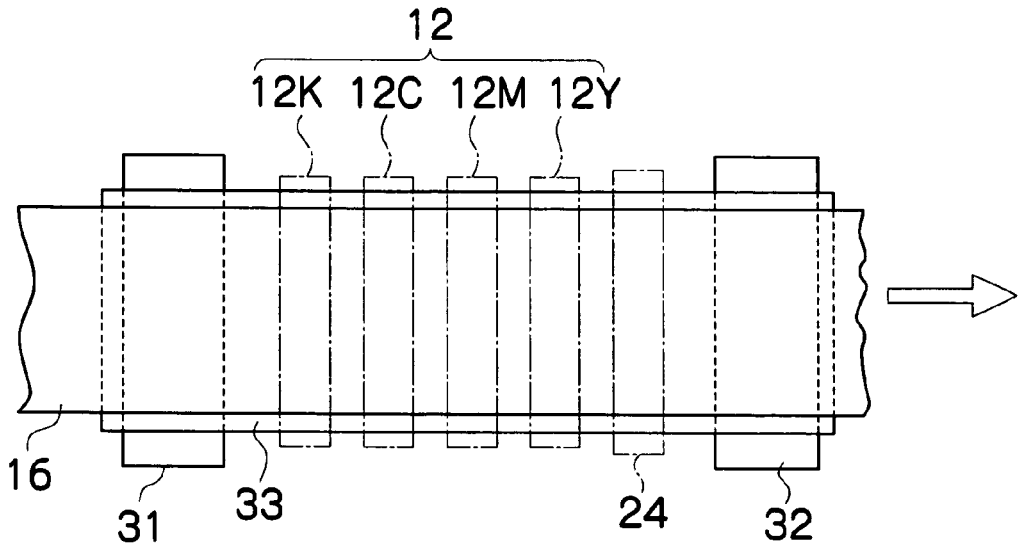
FIG. 2 is a plan view of the principal part of the peripheral area of a print unit in the inkjet recording apparatus shown in FIG. 1.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction).

Each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side (left-hand side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) which is perpendicular to the paper conveyance direction.

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 shown in FIG. 1 has an image sensor (line sensor and the like) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Figure 3:
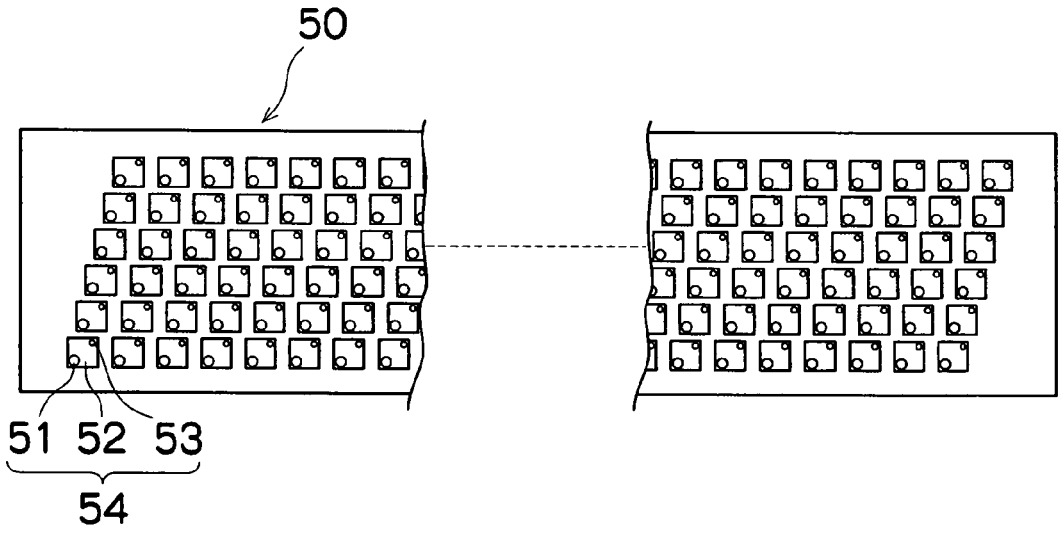
FIG. 3 is a plan perspective diagram showing an example of the structure of the print head.

Next, the arrangement of nozzles (liquid ejection ports) in the print head (liquid ejection head) is described. The print heads 12K, 12C, 12M and 12Y provided for the respective ink colors each have the same structure, and a print head forming a representative example of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle 51 for ejecting ink as ink droplets, a pressure chamber 52 for applying pressure to the ink in order to eject ink, and an ink supply port 53 for supplying ink to the pressure chamber 52 from a common flow channel (not shown in FIG. 3).

In the example shown in FIG. 3, the pressure chambers 52 each have an approximately square planar shape when viewed from above, but the planar shape of the pressure chambers 52 is not limited to a square shape. As shown in FIG. 3, if the pressure chambers 52 have a square planar shape, then a nozzle 51 is formed at one end of the diagonal of each pressure chamber 52, and an ink supply port 53 is provided at the other end thereof.

Figure 4:
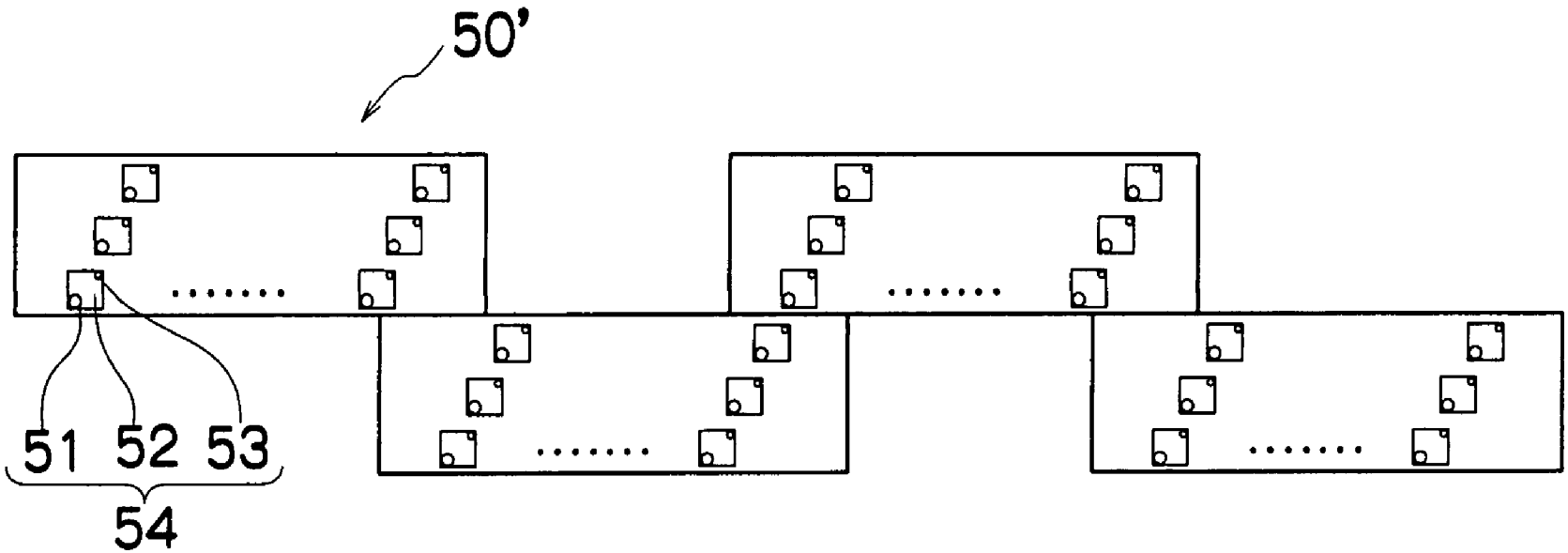
FIG. 4 is a plan view showing a further example of the print head.

Moreover, FIG. 4 is a plan view perspective diagram showing a further example of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
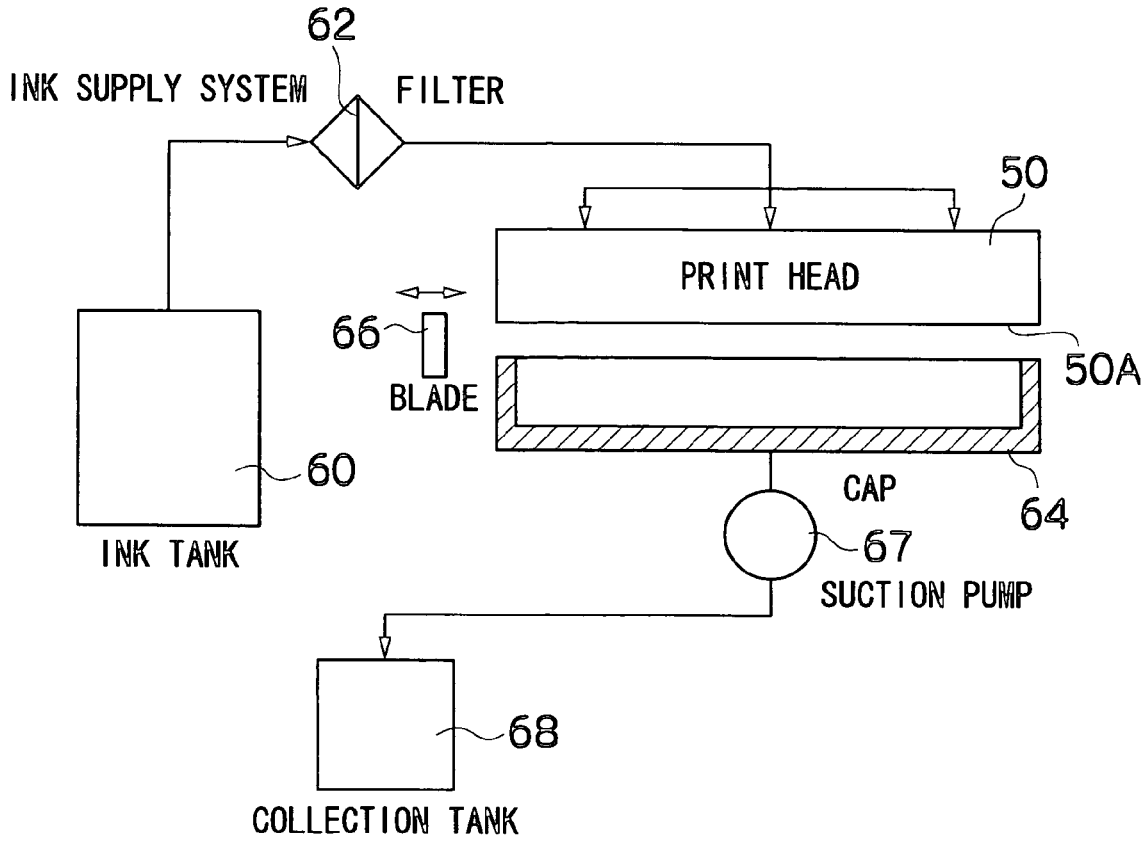
FIG. 5 is a schematic drawing showing the composition of an ink supply system in the inkjet recording apparatus.

FIG. 5 is a schematic drawing showing the configuration of the ink supply system in the inkjet recording apparatus 10.

The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 5. The filter mesh size in the filter 62 is preferably equivalent to or less than the diameter of the nozzle of the print head 50 and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

For the print head 50, the inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face 50A.

A maintenance unit 61 including the cap 64 and the cleaning blade 66 can be relatively moved with respect to the print head 50 by a movement mechanism (not shown), and is moved from a predetermined holding position to a maintenance position below the print head 50 as required.

The cap 64 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 64 to a predetermined elevated position so as to come into close contact with the print head 50, and the nozzle region of the nozzle surface 50A is thereby covered by the cap 64.

The cleaning blade 66 is composed of rubber or another elastic member, and can slide on the ink ejection surface (nozzle face 50A) of the print head 50 by means of a blade movement mechanism (not shown). When ink droplets or foreign matter has adhered to the nozzle face 50A, the surface of the nozzle face 50A is wiped and cleaned by sliding the cleaning blade 66 on the nozzle face 50A.

During printing or standby, when the frequency of use of specific nozzles 51 is reduced and ink viscosity increases in the vicinity of the nozzles 51, a preliminary discharge is made to eject the degraded ink due to the increased viscosity toward the cap 64.

Also, when bubbles have become intermixed in the ink inside the print head 50 (ink inside the pressure chamber 52), the cap 64 is placed on the print head 50, the ink inside the pressure chamber 52 (the ink in which bubbles have become intermixed) is removed by suction with a suction pump 67, and the suction-removed ink is sent to a collection tank 68. This suction action entails the suctioning of degraded ink which is hardened due to its increased viscosity also when initially loaded into the head, or when service has started after a long period of being stopped.

More specifically, when a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the piezoelectric element for the ejection driving (not shown but described later) is operated. Before reaching such a state (in a viscosity range that allows ejection by the operation of the piezoelectric element) the piezoelectric element is operated to perform the preliminary discharge to eject the ink whose viscosity has increased in the vicinity of the nozzle toward the ink receptor. After the nozzle face 50A is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed inside the nozzle 51 or the pressure chamber 52, or when the ink viscosity inside the nozzle 51 has increased over a certain level, ink can no longer be ejected by the preliminary discharge, and a suctioning action is carried out as bellow.

More specifically, if air bubbles have become mixed into the ink in the nozzles 51 or the pressure chambers 52, or if the ink viscosity inside the nozzles 51 has risen to a certain level or above, then even if the piezoelectric elements are operated, it is impossible to eject ink from the nozzles 51. In a case of this kind, a cap 64 is placed on the nozzle surface 50A of the print head 50, and the ink containing air bubbles or the ink of increased viscosity inside the pressure chambers 52 is suctioned by a pump 67.

However, since this suction action is performed with respect to all the ink in the pressure chambers 52, the amount of ink consumption is considerable. Therefore, a preferred aspect is one in which a preliminary discharge is performed when the increase in the viscosity of the ink is small. The cap 64 shown in FIG. 5 functions as a suctioning device and it may also function as an ink receptacle for preliminary ejection.

Moreover, desirably, a composition is adopted in which the inside of the cap 64 is divided by means of partitions into a plurality of areas corresponding to the nozzle rows, thereby achieving a composition in which suction can be performed selectively in each of the demarcated areas, by means of a selector, or the like.

As described hereinafter, a restoration operation for the head (nozzles), such as purging or suctioning of this kind, is carried out as appropriate in accordance with the determination results of the ejection failure determination device.

Figure 6:
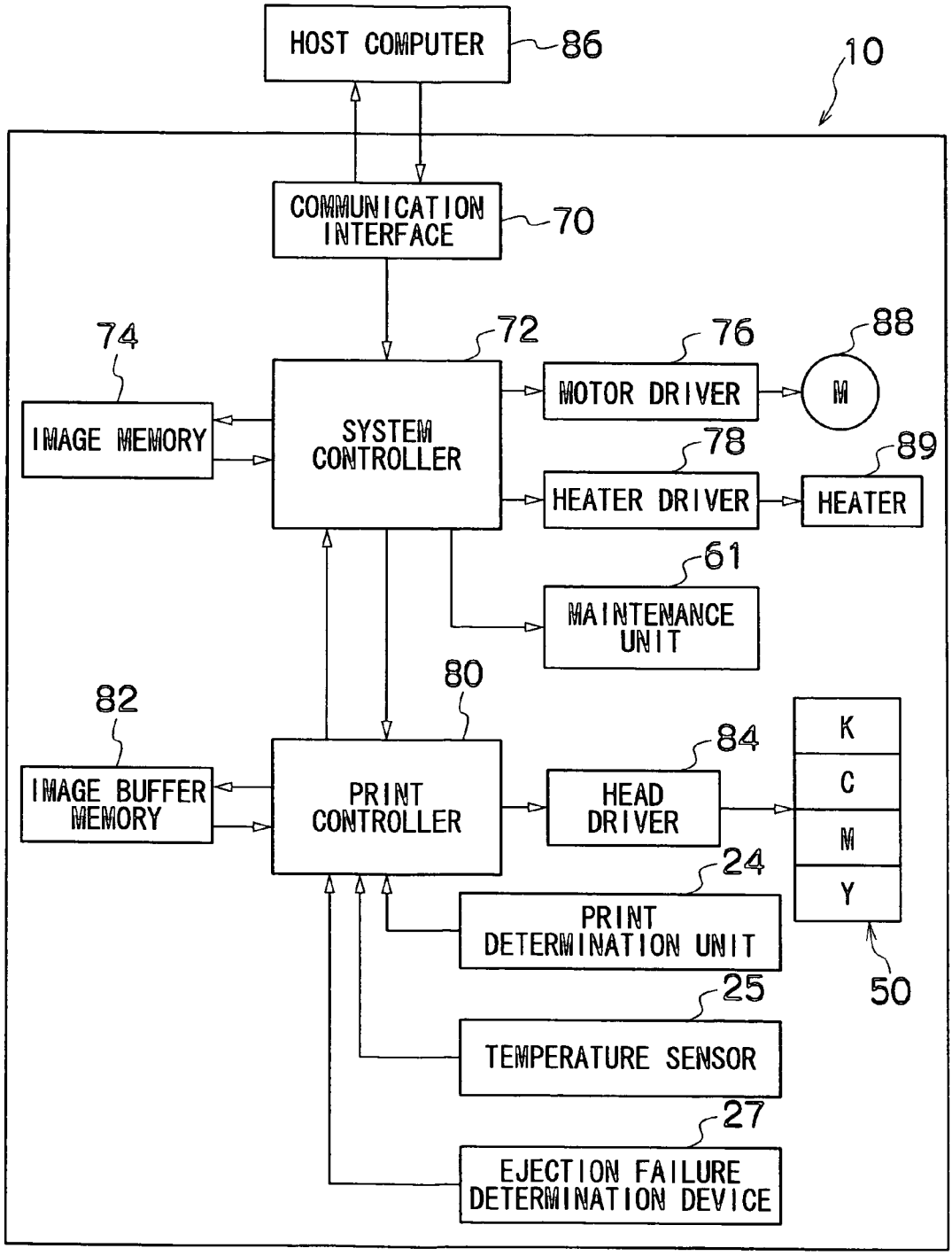
FIG. 6 is a partial block diagram showing the system composition of the inkjet recording apparatus.

FIG. 6 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver 76 is a driver (drive circuit) which drives the motor 88 in accordance with instructions from the system controller 72. The heater driver 78 is a driver which drives the heater 89 in accordance with instructions from the system controller 72. This heater 89 includes a heater for a post drying unit 42 and a heater for heating the ink. Although described in more detail hereinafter, the heater 89 for heating ink heats the ink, thereby raising the ink temperature and reducing the ink viscosity, when there is a risk of ejection failure due to an increase in the viscosity of the ink, and hence it serves to prevent ejection failures. The heater 89 for heating the ink is not limited in particular, and it may be provided in the ink tank 60 in such a manner that it raises the temperature of all of the ink, or alternatively, heaters 89 may be provided independently for each print head 50 (for example, in the ink supply channels leading to the respective print heads 50) in such a manner that the ink temperature can be controlled independently in each of the print heads 50. Furthermore, it is also possible to adopt a composition which enables the ink temperature to be controlled respectively in each pressure chamber 52, or in each region comprising a plurality of pressure chambers 52.

The print controller 80 has a signal processing function for performing various tasks, compensations, and other types of processing for generating print control signals from the image data stored in the image memory 74 in accordance with commands from the system controller 72 so as to supply the generated control signal (print data) to the head driver 84. Prescribed signal processing is carried out in the print controller 80, and the ejection amount and the ejection timings of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric element of the print heads 50 of the respective colors on the basis of print data supplied by the print controller 80. The head driver 84 can be provided with a feedback control system for maintaining constant drive conditions for the print heads.

As shown in FIG. 1, the print determination section 24 is a block including a line sensor (not shown), which reads in the image printed onto the recording paper 16, performs various signal processing operations, and the like, and determines the print situation (presence/absence of ejection, variation in droplet ejection, and the like). The print determination section 24 supplies these detection results to the print control unit 80.

Pressure sensors which determine ejection defects by determining the ink pressure inside the pressure chambers 52 of the print head 50 are provided as devices (the ejection failure determination device 27) for determining the ejection state (ejection defects, such as ejection failure, deflection of the flight direction, or the like). In particular, in the present embodiment, pressure sensor members are provided in two layers for each of the pressure chambers 52, and the electrical wires are devised in such a manner that only one of the pressure sensor members functions as a pressure sensor for each of the pressure chambers 52. This is described in more detail below.

According to requirements, the print controller 80 makes various corrections with respect to the print head 50 on the basis of information obtained from the print determination section 24. Furthermore, as a device for measuring changes in the ambient environment which may affect the ejection state, it is also possible to provide the print head 50 with a temperature sensor 25 which measures changes in the ambient temperature, or the like. In this case, the print controller 80 uses the ink temperature determined by the temperature sensor 25, for example, to calculate the ink viscosity and determines the ejection state, on the basis of a relationship between the ink temperature and the ink viscosity corresponding to previously established ink characteristics. Other changes in the ambient environment which may affect the ejection state include, for example, the changes of the humidity, atmospheric pressure, or the like.

Furthermore, the print controller 80 receives a determination signal from the print determination section 24 or the ejection failure determination device 27 located separately from the print determination section 24, and a restoration operation (maintenance) for the print head 50 is performed by driving the maintenance unit 61 via the system controller 72, as and when necessary. The ejection failure determination and restoration operations are described in detail hereinafter.

In the present embodiment, in order to achieve high density in a print head, firstly, a high-density arrangement of nozzles 51 is obtained (for example, 2400 npi) by arranging pressure chambers 52 (nozzles 51) in the form of a two-dimensional matrix, as shown in FIG. 3 for example. Next, the ink supply system is integrated to a high degree by disposing a common liquid chamber for supplying ink to the pressure chambers 52 above the diaphragm, and ink refilling characteristics are prioritized by eliminating tubing which causes flow resistance, in such a manner that the ink is supplied directly from this common liquid chamber to the pressure chambers 52. Furthermore, in the present embodiment, the piezoelectric element wires which supply drive signals to the electrodes (individual electrodes) of the piezoelectric elements that deform the pressure chambers 52, rise upward vertically from individual electrodes respectively, are made to pass through the common liquid chamber, and consequently is connected to an upper wire such as a flexible cable.

Figure 7:
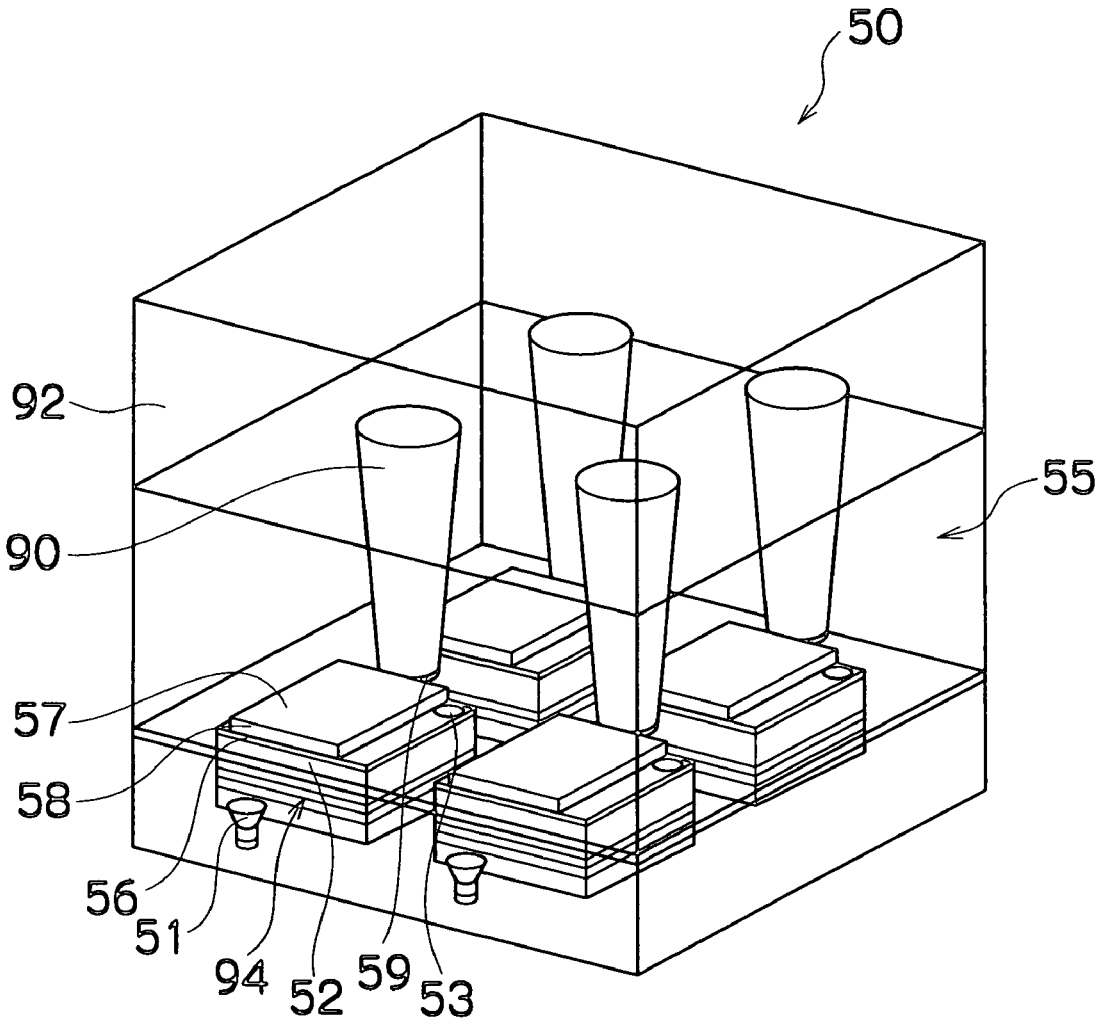
FIG. 7 is an oblique perspective diagram showing a partial enlarged view of the print head.

FIG. 7 shows a simplified oblique perspective view of one portion of the print head 50 with the high density configuration.

As shown in FIG. 7, in the print head 50 according to the present embodiment, a diaphragm 56 forming the ceilings of the pressure chambers 52 is disposed, as a single common plate for a plurality of pressure chambers 52, on the upper side of pressure chambers 52 each having a nozzle 51 and an ink supply port 53. Furthermore, piezoelectric elements 58 (pressure generating devices), each constituted by a piezoelectric body sandwiched between upper and lower electrodes, are disposed on the diaphragm 56 in regions corresponding to the pressure chambers 52, and an individual electrode 57 is provided on the upper surface of each piezoelectric element 58.

An electrode pad 59 forming an electrode connecting section is extended to the outer side from the end face of each individual electrode 57, and a column-shaped drive wire 90 is formed on this electrode pad 59 so as to rise up in a perpendicular direction with respect to the surface on which the piezoelectric element 58 is formed. A multi-layer flexible cable 92 is provided above the drive wires 90 which rise up in the perpendicular direction, and drive signals are supplied from the head driver 84 to the individual electrodes 57 of the piezoelectric elements 58 via these wires.

Furthermore, the pressure sensor members 94 forming the ejection failure determination device 27 (pressure sensor) for determining the ink pressure inside the pressure chambers 52, are provided below the bottom surface of the pressure chambers 52. There are no particular limitations on the pressure sensor members 94, and a piezoelectric element layer made of PVDF (polyvinylidene fluoride), P(VDF-TrFE) (polyvinylidene-trifluoride ethylene copolymer), or the like can be suitably used, for example.

Similarly to the diaphragm 56, PVDF is disposed as a common layered sheet with respect to a plurality of pressure chambers 52. The electrodes are provided in the pressure determination regions on the lower side of the pressure chambers 52, and thereby it is possible to independently determine the pressure of each of the pressure chambers 52. The electrodes can be formed by printing; by applying metal by vapor deposition or sputtering and then etching away the unnecessary portions; or by applying metal by vapor deposition or sputtering, using a metal mask which covers the unnecessary portions.

Furthermore, in the present embodiment, the pressure sensor members 94 are formed in two layers on the lower side of the pressure chambers 52. In other words, the PVDF plate is formed in two layers, and an insulating layer is formed therebetween. Both surfaces of each of the PVDF plates are sandwiched between electrodes. The pressure sensor members 94 are disposed in two layers; however, at each of the pressure chambers 52, only one of the two layers forms an effective determination section which functions as a pressure sensor for actually determining the pressure in the corresponding pressure chamber 52. The electrodes which are effective for pressure determination are disposed in mutually opposing fashion on only one of the two PVDF layers. For example, the locations of the electrodes are allocated in an alternating fashion between the upper layer and the lower layer of the two layers of PVDF, with respect to each column of the pressure chambers 52 arranged in the two-dimensional configuration. Consequently, considering each layer of PVDF, the electrodes are provided with respect to every other column of pressure chambers 52 in each of the layers. Furthermore, in this case, high-density arrangement of the electrical wires is achieved by passing the electrical wires extended from the electrodes through the empty regions where electrodes are not provided (in the horizontal direction).

Furthermore, as shown in FIG. 7, the space in which the column-shaped drive wires 90 are formed so as to rise up perpendicularly between the diaphragm 56 and the flexible cable 92 is formed into a common liquid chamber 55 for supplying ink to the pressure chambers 52 via the ink supply ports 53.

The common liquid chamber 55 shown here is one large space formed throughout the whole region where the pressure chambers 52 are formed in such a manner that it supplies ink to all of the pressure chambers 52 shown in FIG. 3; however, the common liquid chamber 55 is not limited to being formed into one space, and a plurality of chambers may be formed by dividing up the space into several rooms.

The drive wires 90 which rise up perpendicularly in the form of columns in this way, may also be called electrical columns, derived from their shape. In this way, the drive wires (electrical column) 90 are formed so as to pass through the common liquid chamber 55.

The drive wires 90 shown here are formed independently with respect to each of the piezoelectric elements 58 (or the individual electrodes 57 thereof), in a one-to-one correspondence; however, in order to reduce the number of wires (the number of electrical columns), it is also possible to make one drive wire 90 correspond to a plurality of piezoelectric elements 58 in such a manner that the wires corresponding to several piezoelectric elements 58 are gathered together and formed into one drive wire 90. In this case, the plurality of wires connected to the individual electrodes of a plurality of piezoelectric elements 58 are gathered together in a state where each of the plurality of wires is kept independent (isolated), when they are formed into one drive wire 90. Consequently, it is possible to reduce the number of column-shaped drive wires 90 as well as to reduce the flow resistance of the ink in the common liquid chamber 55.

As shown in FIG. 7, a nozzle 51 is formed in the bottom surface of each pressure chamber 52, and an ink supply port 53 is provided in the upper surface thereof in a corner section which is symmetrical with respect to the nozzle 51. The ink supply ports 53 are pierced through the diaphragm 56, and the common liquid chamber 55 located thereon and the pressure chambers 52 are connected directly via the ink supply ports 53. Consequently, it is possible to form a direct fluid connection between the common liquid chamber 55 and each of the pressure chambers 52.

As described above, the diaphragm 56 is formed as a single plate which is common to all of the pressure chambers 52. Each of the piezoelectric elements 58 for deforming the pressure chambers 52 is disposed on the diaphragm 56 in a position corresponding to each of the pressure chambers 52. Electrodes (a common electrode and an individual electrode) for driving the piezoelectric elements 58 by applying a voltage to same are formed on the upper and lower surfaces of each piezoelectric element 58, and accordingly the piezoelectric element 58 is sandwiched between the electrodes.

The diaphragm 56 may be formed as a thin conductive film such as a film of stainless steel, in such a manner that the diaphragm 56 may also serve as a common electrode. In this case, each individual electrode 57 for driving the piezoelectric element 58 independently is provided on the upper surface of each of the piezoelectric elements 58.

As described above, the electrode pad 59 is formed so as to extend from each individual electrode 57, and the drive wire 90 (electrical column) which passes through the common liquid chamber 55 is formed so as to rise up perpendicularly from the electrode pad 59. The multi-layer flexible cable 92 is formed on top of the column-shaped drive wires 90 in such a manner that the multi-layer flexible cable 92 is supported by the pillars formed by the drive wires 90, and the space forming the common liquid chamber 55 is formed by taking the diaphragm 56 as the base, and the multi-layer flexible cable 92 as the ceiling. Although not shown in the drawings, the each of the individual electrodes 57 is connected independently to each of the drive wires 90 in such a manner that drive signals are supplied to the individual electrodes 57 respectively, and thereby the piezoelectric elements 58 are driven.

Furthermore, although not shown in FIG. 7, since the common liquid chamber 55 is filled with ink, the surface of the diaphragm 56 forming the common electrode, the surface of the individual electrodes 57, the surface of the drive wires 90 and the surface of the multi-layer flexible cable 92 which make contact with the ink are respectively covered with insulating protective films.

Figure 8:
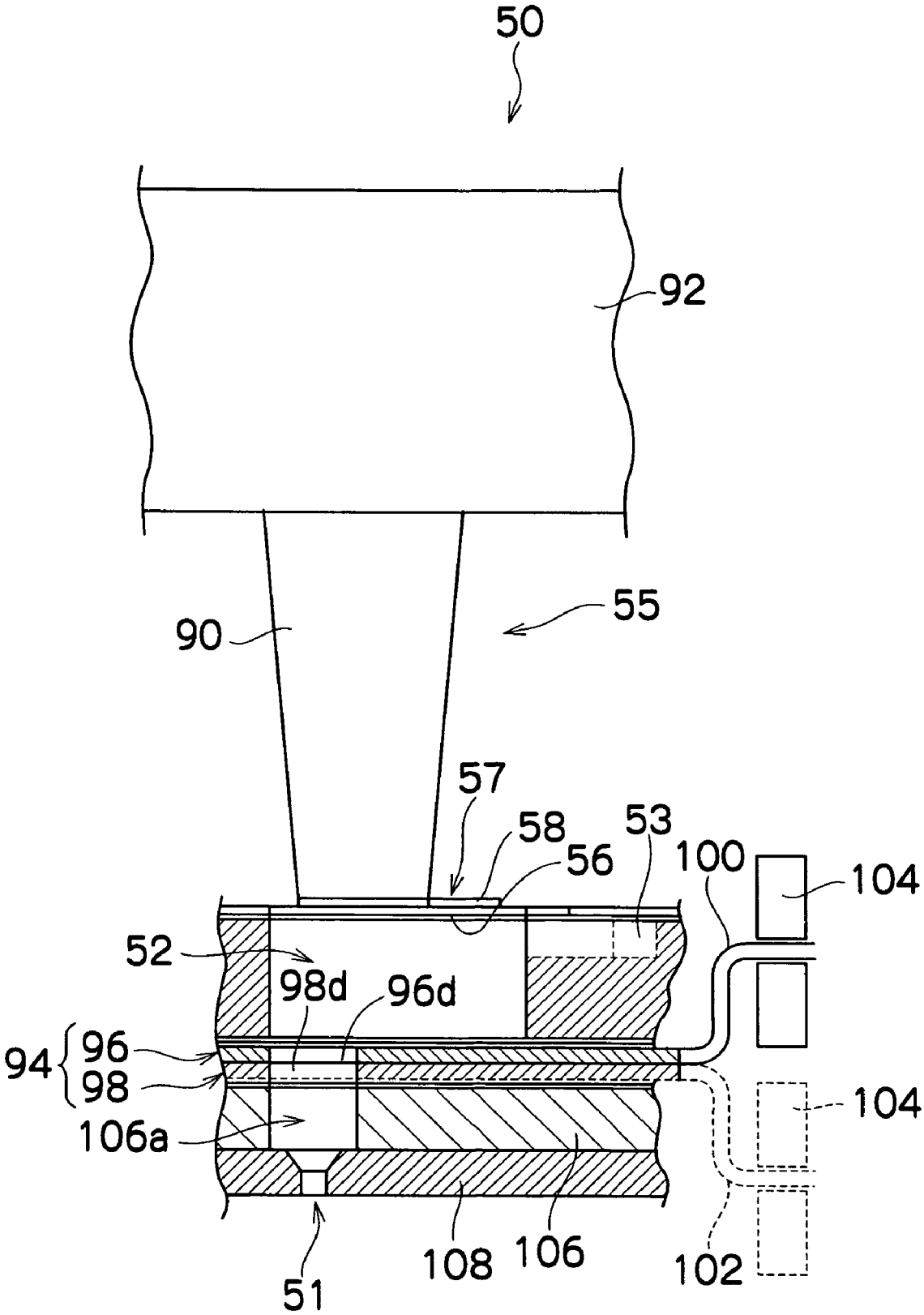
FIG. 8 is a cross-sectional front side perspective diagram showing a partial enlarged view of the print head.

FIG. 8 is a cross-sectional front side perspective diagram showing an enlarged view of a portion of the print head 50 in the present embodiment.

As shown in FIG. 8, piezoelectric elements 58 are formed on the diaphragm 56 which forms the upper surface of the pressure chambers 52, column-shaped drive wires 90 connected electrically to the individual electrodes 57 on the piezoelectric elements 58 are formed thereon, and the multi-layer flexible cable 92 is formed on top of these drive wires 90. The space between the diaphragm 56 and the multi-layer flexible cable 92 formed by the column-shaped drive wires 90 creates the common liquid chamber 55, in such a manner that ink is supplied from the common liquid chamber 55 to the pressure chambers 52 via the ink supply ports 53.

Furthermore, the pressure sensor members 94 are formed on the lower side of each pressure chamber 52. The pressure sensor members 94 are constituted by two layers, an upper layer 96 and a lower layer 98. An insulating layer is formed between the upper layer 96 and the lower layer 98, and electrodes are provided with respect to only one of the upper layer 96 or the lower layer 98, thereby allowing the layer to function as the effective determination section. An electrical wire (pair) 100 (or 102) which carries a determination signal is extended from the electrode and is connected to a connector 104 on the outside of the print head 50.

A stainless steel nozzle flow channel plate 106 provided with nozzle flow channels 106*a* is formed below the pressure sensor member 94, and a nozzle plate 108 provided with nozzles 51 is formed below the nozzle flow channel plate 106. Furthermore, holes 96*d* and 98*d* for connecting the pressure chambers 52 with the nozzle flow channels 106*a* are formed respectively in the upper layer 96 and the lower layer 98 which constitute the pressure sensor member 94.

Figure 9:
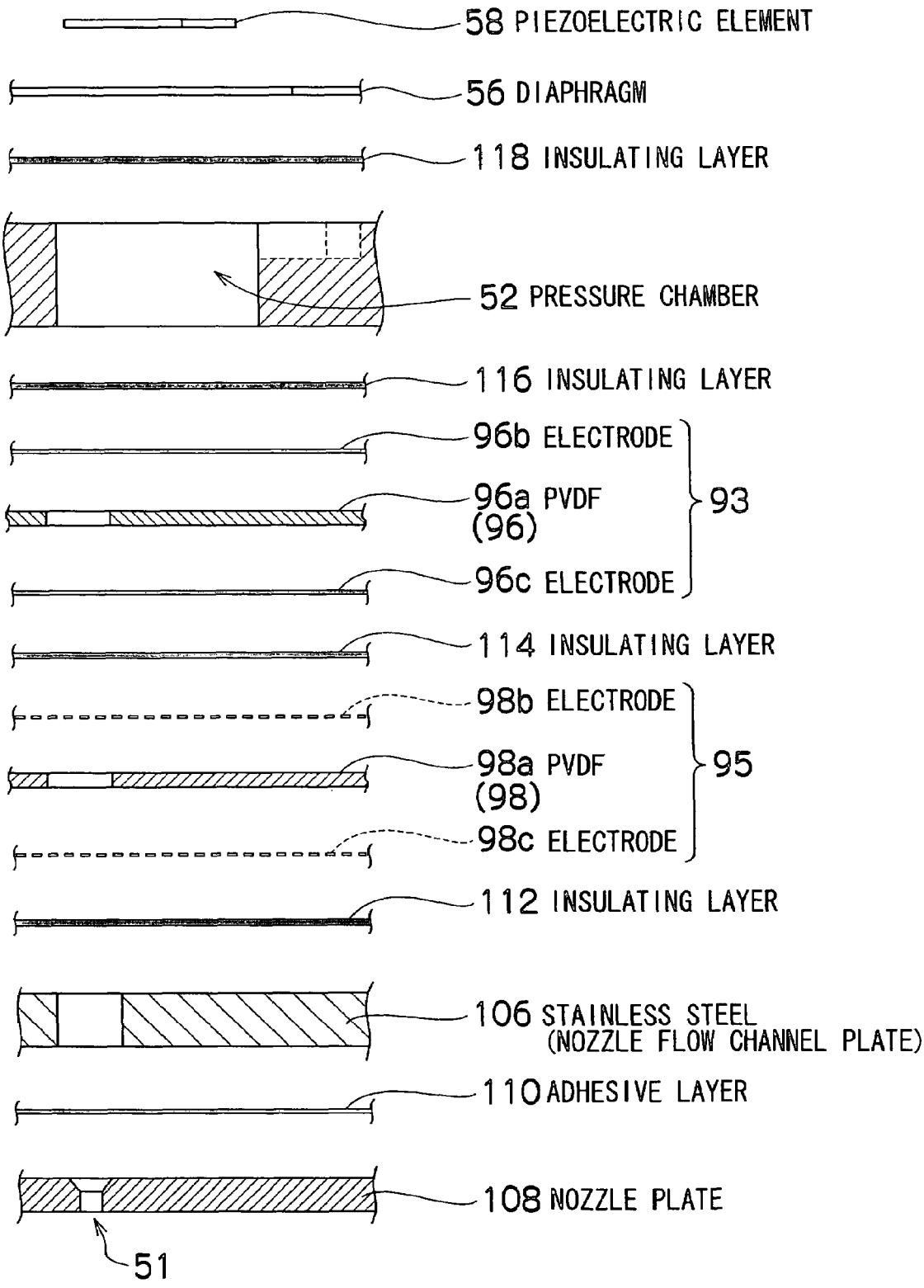
FIG. 9 is a side view showing an exploded view of the respective elements which constitute the print head.

FIG. 9 shows a side diagram in which the components of this print head 50 on the lower side from the piezoelectric element 58 are depicted in an exploded view.

As shown in FIG. 9, the print head 50 in the present embodiment is formed by laminating together various thin film layers. Starting the description from the lower end of these layers, firstly, the nozzle plate 108 formed with the nozzles 51 as shown in FIG. 9 is bonded to the nozzle flow channel plate 106 made of stainless steel, via an adhesive layer 110. An insulating layer 112 which also serves as an adhesive layer is laminated onto the nozzle flow channel plate 106, and PVDF 98*a* is formed thereon in order to form the lower layer 98 of the pressure sensor member 94. If the lower layer 98 (PVDF 98*a*) is made to function as the effective determination section, then the lower layer pressure sensor 95 is constituted in such a manner that the both surfaces of the PVDF 98*a* are sandwiched between two electrodes 98*b* and 98*c*.

Furthermore, PVDF 96*a* is formed on the lower layer pressure sensor 95 via an insulating layer 114, as the upper layer 96 of the pressure sensor member 94. If the upper layer 96 (PVDF 96*a*) is made to function as the effective determination section, then the upper layer pressure sensor 93 is constituted in such a manner that the two surfaces of the PVDF 96*a* are sandwiched between two electrodes 98*b* and 98*c*. However, in actual practice, the electrodes 98*b*, 98*c* and the electrodes 96*b*, 96*c* are not formed simultaneously in this way on the portions of both the lower layer 98 and the upper layer 96 corresponding to the same pressure chamber 52. Each of the PVDF layers 98*a* and 96*a* are layered as a single plate over the whole surface; however, since only one of the PVDF layers 98*a* and 96*a* is used as a pressure sensor (the upper layer pressure sensor 93 or the lower layer pressure sensor 95) in respect of each pressure chamber 52, only one of the sets of electrodes 98*b*, 98*c* and electrodes 96*b*, 96*c* is disposed beneath each pressure chamber 52. For example, in the case of the pressure chamber 52 shown in FIG. 9, the electrodes 98*b* and 98*c* corresponding to the effective determination section of the lower layer PVDF 98*a* are depicted by a broken line because they are not provided at this pressure chamber 52, whereas the electrodes 96*b* and 96*c* are provided to correspond to the upper layer PVDF 96*a* only.

Furthermore, an insulating layer 116 which also serves as an adhesive layer is laminated on top of the upper layer pressure sensor 93, the pressure chamber 52 having an approximately square planar shape is formed thereon, and the diaphragm 56 bonded with an insulating layer 118 is formed on top of the pressure chamber 52. The piezoelectric element 58 is formed on the diaphragm 56.

To give examples of the dimensions of the elements, the layers have the following thicknesses. For example, the nozzle plate 108 is 50 μm thick, the adhesive layer 110 is 2 μm thick, and the nozzle flow channel plate (stainless steel) 106 is 80 μm thick. Furthermore, the insulating layers 112 and 116 and the insulating layers 114 and 118, which also serve as adhesive layers, are 5 μm thick, the electrodes 98*b*, 98*c*, 96*b*, 96*c* are 1 μm thick, and the PVDF layers 98*a* and 96*a* are 20 μm thick. The height of the pressure chambers 52 is 150 μm.

In actual manufacturing steps, an integrated sheet where the electrodes 98*b*, 98*c* or electrodes 96*b*, 96*c*, and the insulating layers 112, 114 and 116 are layered onto the PVDF layers 98*a* and 96*a*, may be layered onto the stainless steel nozzle flow channel plate 106. Alternatively, the layers may be formed successively on the stainless steel nozzle flow channel plate 106, whereupon this plate may be laminated with another stainless steel base plate. Subsequently, the drive wires 90, and the like, are installed.

Figure 10:
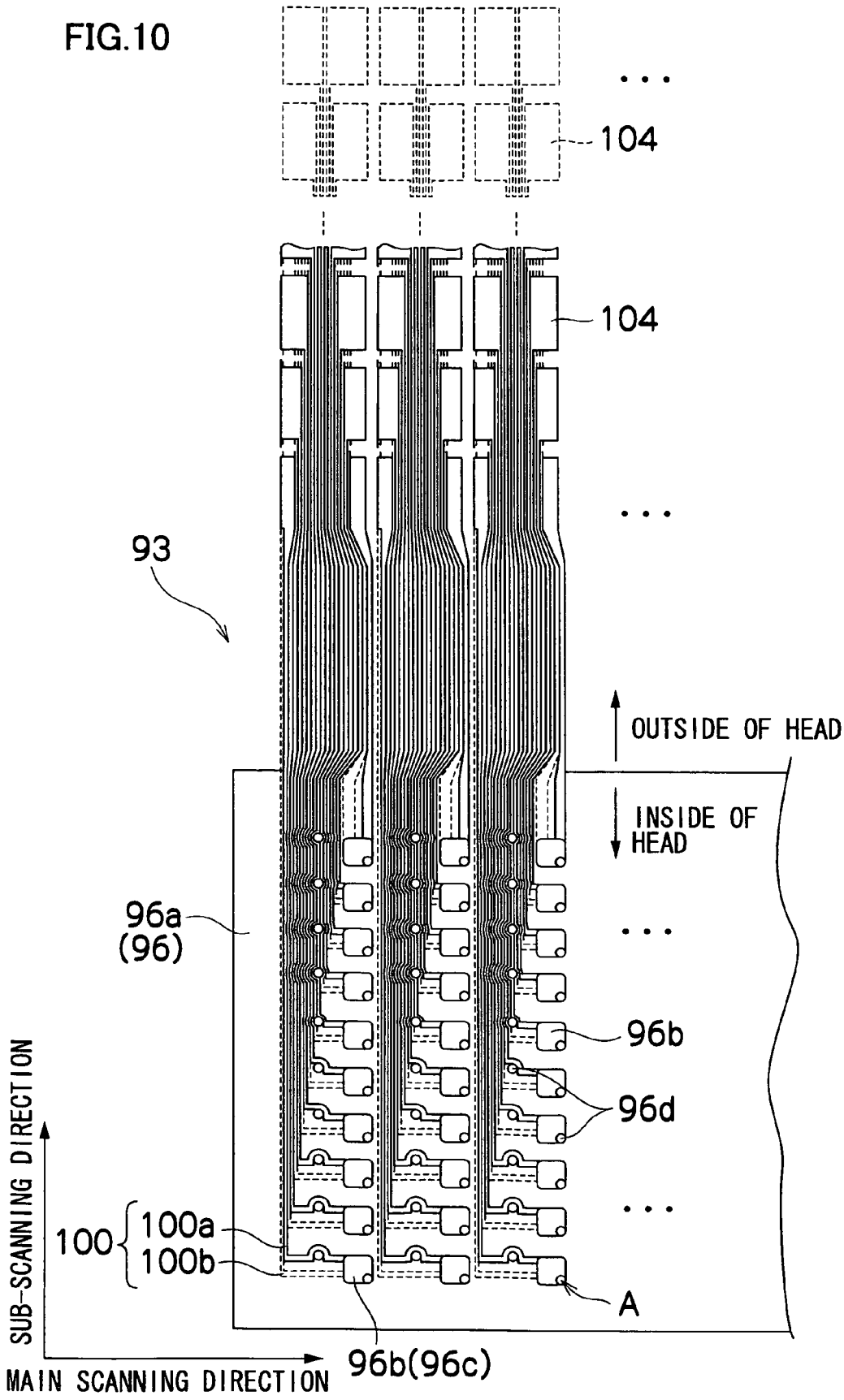
FIG. 10 is a plan view perspective diagram showing an example of an upper layer pressure sensor.
Figure 11:
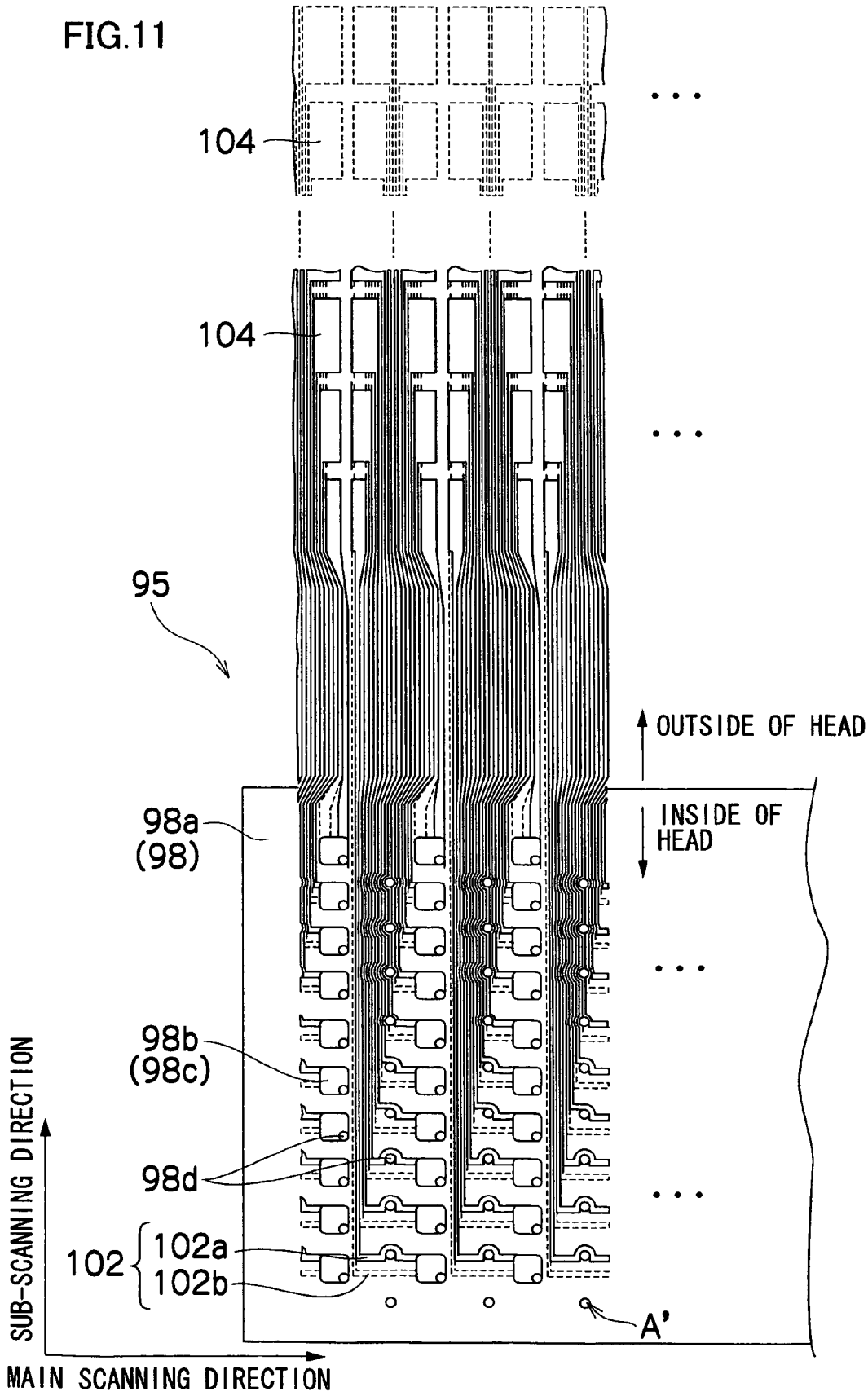
FIG. 11 is a plan view perspective diagram showing an example of a lower layer pressure sensor.

FIG. 10 shows a plan perspective diagram of the upper layer pressure sensor 93, and FIG. 11 shows a plan perspective diagram of the lower layer pressure sensor 95. In FIG. 10 and FIG. 11, the horizontal direction represents the main scanning direction, that is, the lengthwise direction of the print head 50; and the vertical direction represents the sub-scanning direction, that is, the width direction of the print head 50.

Furthermore, the holes 96*d* (indicated by small white circles) which connect to the nozzle flow channels 106*a* (see FIG. 8) are formed in line with the two-dimensional matrix nozzle arrangement, in the PVDF 96*a* which forms the pressure sensor member of the upper layer pressure sensor 93 shown in FIG. 10. Similarly, the holes 98*d* (indicated by small white circles) which connect to the nozzle flow channels 106*a* are formed in line with the two-dimensional matrix nozzle arrangement, in the PVDF 98*a* which forms the pressure sensor member of the lower layer pressure sensor 95 shown in FIG. 11. The holes indicated by reference numerals A in FIG. 10 coincide with the holes indicated by the reference numerals A' in FIG. 11.

Firstly, in the upper layer pressure sensor 93 shown in FIG. 10, the electrodes 96*b* and 96*c* are formed in positions corresponding to the pressure chambers 52 relating to the nozzles 51, in parallel with the columns of the holes 96*d* corresponding to the nozzle arrangement aligned in the longitudinal direction in the diagram, at every other column (at the evennumbered columns counting from the left-hand side in the example shown in FIG. 10). The electrode 96*b* and the electrode 96*c* are formed at the same positions on either side of the PVDF 96*a*, and in the diagram, only the electrodes 96*b* formed on the upper side are depicted (the electrodes 96*c* corresponding to these are also formed directly below the electrodes 96*b*).

Furthermore, electrical wires 100*a* represented by solid lines in the drawing are extended from the electrodes 96*b*, and electrical wires 100*b* represented by broken lines in the drawing are extended from the electrodes 96*c*. These electrical wires 100*a* and 100*b* are extended so as to avoid the holes 96*d* corresponding to the nozzles 51, and are extended in the sub-scanning direction over the columns where the electrodes 96*b* (96*c*) are not formed, and are connected to the connectors 104 outside the head.

Furthermore, the lower layer pressure sensor 95 shown in FIG. 11 is also formed in a similar fashion to the upper layer pressure sensor 93 described above, and the positions of the electrodes 98*b* (98*c*) formed corresponding to the pressure chambers 52 are shifted by one column with respect to the electrode positions in the upper layer pressure sensor 93. More specifically, in the example of the lower layer pressure sensor 95 shown in FIG. 11, the electrodes 98*b* (98*c*) are formed with respect to the odd-numbered columns (counting from the left-hand side in FIG. 11) of the columns of holes 98*d* corresponding to the nozzles 51.

The electrical wires 102*a* shown by the solid lines in FIG. 11 are extended from the electrodes 98*b*, and the electrical wires 102*b* shown by the broken lines in FIG. 11 are extended from the electrodes 98*c*. These wires are extended in the sub-scanning direction over the columns where the electrodes 98*b* (98*c*) are not formed, while avoiding the positions of the holes 98*d*. Consequently, the wires are connected to the connectors 104 outside the head.

In this way, in the present embodiment, the pressure sensor member 94, which is constituted by a single layer in the related art, has a two-layer structure comprising the upper layer 96 and the lower layer 98. Furthermore, as shown in FIGS. 10 and 11, the electrodes which cause the pressure sensors to function are disposed in every other column in the main scanning direction of the arrangement corresponding to the two-dimensional matrix nozzle arrangement. Therefore, spaces are provided between the electrodes arrayed in the sub-scanning direction, in such a manner that the electrical wires extended from the electrodes can be disposed in these spaces.

For example, here a case is considered in which a two-layer structure is adopted for the pressure sensors, as in the present embodiment, and a 2400 dpi arrangement is achieved. If the pressure chambers are aligned at intervals of 0.5 mm in the longitudinal and lateral directions, the size of the pressure chambers (which is equivalent to the size of the pressure sensors) becomes 0.3 mm in the longitudinal and lateral directions, and the two-layer structure as in the present embodiment is not adopted, then the size of the spaces in which the wires can actually be laid becomes 0.2 mm (i.e., 0.5 mm−0.3 mm=0.2 mm). On the other hand, if 2400 dpi with a pitch (interval) of 0.5 mm is adopted, then the number of columns of pressure chambers in the sub-scanning direction of the matrix arrangement becomes approximately 48, because the following relationship is established: 0.5/(25.4/2400)=47.2. Moreover, if the wires are extended in both directions in the width direction of the head (sub-scanning direction), then the number of columns of pressure chambers on one side becomes one half of the total of 48, namely 24; however, the wire(s) which corresponds to one of the columns of pressure chambers is not necessarily required to pass through the space between the other sensors, and hence the number of columns of pressure chambers becomes ultimately 23 (i.e., 24−1=23). Accordingly, if the two-layer structure as in the present embodiment is not adopted, then the wiring pitch (wiring interval) becomes approximately 8.7 (μm) (i.e., 0.2 (mm)/23≈8.7 (μm)), and although the wiring width becomes approximately one half of this value, it is difficult to achieve this value as the wiring pitch in view of technological aspects.

On the other hand, by establishing the two layer arrangement and disposing the electrodes in every other column, the number of the spaces in which the wires can be laid increases because the spaces corresponding to empty columns are made, and consequently the size of the spaces in which the wires can be laid becomes 0.5 mm. The flow channels (nozzle flow channels) from the pressure chambers to the nozzles are formed in these spaces, and hence it is difficult to lay the wires in the areas of these nozzle flow channels having the diameter of 0.1 mm (however, this restriction may be disregarded if the sensors are not provided on the nozzle side). Therefore, by arranging the sensors in two layers and disposing the electrodes at every other column, then the size of the spaces in which the wires can be laid becomes 0.6 mm (i.e., 0.2 mm+0.5 mm−0.1 mm=0.6 mm).

In this way, according to the present embodiment, the size of the spaces in which the wires can be laid is 0.6 mm, and therefore, the wiring pitch is 26 (μm) (i.e., 0.6 (mm)/23≈26 (μm)), which is a pitch that can be achieved in practice. In this way, according to the present embodiment, it is possible to achieve a high density arrangement of the electrical wires from the pressure sensors.

In the embodiment described above, the pressure sensor members are constituted by two layers; however, the number of layers of the pressure sensor members is not limited to two layers in the present invention. It is also possible to use three or more layers, according to the required density of the sensor arrangement. Furthermore, in the case of the two-layer structure, the electrodes are disposed at every other column in the main scanning direction; on the other hand, generally speaking, if the pressure sensor members are constituted by n layers, then the electrodes are disposed at every (n−1) columns, in the main scanning direction. In this way, by adopting a multiple-layer structure (a two-layer structure in the embodiment described above) for the pressure sensor members, the problem of wiring density is improved; however, by arranging the pressure sensor members in multiple layers, the lower layer pressure sensor member determine the pressure via the upper layer pressure sensor member. Consequently, there is a problem in that the pressure determination sensitivity is different between the upper layer and the lower layer.

Figure 12:
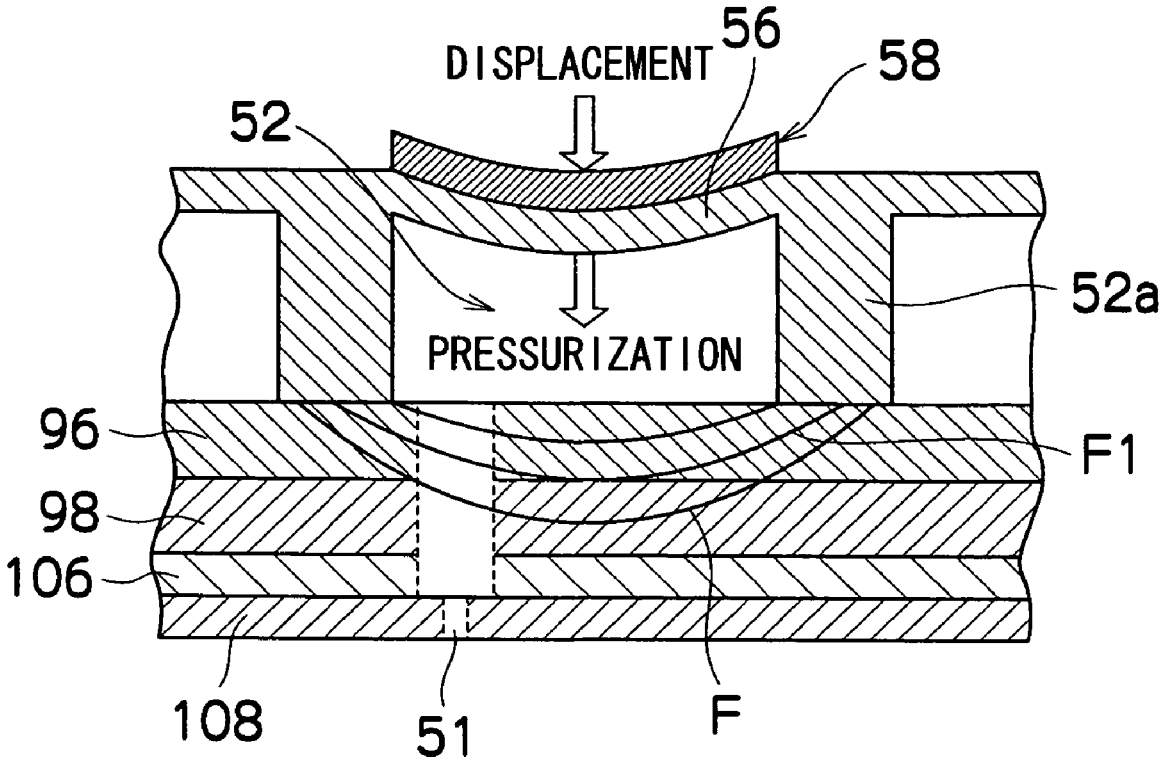
FIG. 12 is a schematic drawing showing the propagation of pressure.

As shown in FIG. 12, the pressure generated in the pressure chamber 52 when the diaphragm 56 is deformed by the displacement of the piezoelectric element 58 spreads through the pressure sensor member 94, and the absolute value of the pressure is reduced in the lower layer 98. In other words, the pressure suffers loss as it propagates.

This phenomenon is shown by the contour lines of the pressure distribution indicated by reference numeral F in FIG. 12, and is thought to be caused by the following mechanism: namely, when a pressure is applied, the members forming the non-determination sections of the upper layer 96 in the pressure sensor 94 (the sections corresponding to the pressure chamber walls 52*a*, or the sections constituting the adjacent pressure chambers 52) are not readily deformable, and therefore, the pressure is transmitted outwards from the region of the pressure chamber 52, as indicated by the reference numeral F1.

In this way, in the present embodiment, the pressure sensor members 94 are formed in two layers, namely the upper layer 96 and the lower layer 98, and either one of the pressure sensor members 94, namely either the upper layer 96 or the lower layer 98, is used as the effective determination section for any one pressure chamber 52. However, if the same input pressure is determined by using the upper layer 96 and by using the lower layer 98 separately, then the determination sensitivities and the output voltages between the case where the determination is carried out with the upper layer 96 and the case where the determination is carried out with the lower layer 98 are different. Consequently, there may be a problem that it is difficult to carry out the pressure determination accurately.

Various methods to resolve this problem have been devised, and some of the methods are described below.

In a first solution, the lower sensor layer (pressure sensor member) is formed so as to have a greater thickness than that of the upper sensor layer (pressure sensor member), in such a manner that the same voltage is output from either layer in response to the same pressure input.

The output voltage of the pressure sensor members is directly proportional to the thickness thereof. On the other hand, the amount of the pressure transmission loss described above varies according to the thickness of the pressure sensor members, the composition relating to the rigidity of the pressure sensor members, and the dimensions of the pressure chambers. However, if these factors are fixed, then it is possible to estimate the ratio of the loss, within the range used for determining pressure.

Due to this loss, in the sensor composition having the upper layer and the lower layer of the same thickness, the output voltage of the lower layer may be smaller compared to that of the upper layer. In this case, the output voltage ratio PL between the upper layer and the lower layer can be expressed as:

$$PL=(\text{output voltage of the lower layer})/(\text{output voltage of the upper layer}). \quad (1)$$

Accordingly, in order to obtain the output voltage of the lower layer pressure sensor member which is equivalent to that of the upper layer pressure sensor member, considering the fact that the output voltage of the pressure sensor members is directly proportional to the thickness of the pressure sensor members, it is possible to fix the thickness of the lower layer of the pressure sensor member as described in the following formula (2), on the basis of the formula (1):

$$(\text{the thickness of the lower layer pressure sensor member})=(\text{the thickness of the upper layer pressure sensor member})\times PL. \quad (2)$$

Figure 13A:
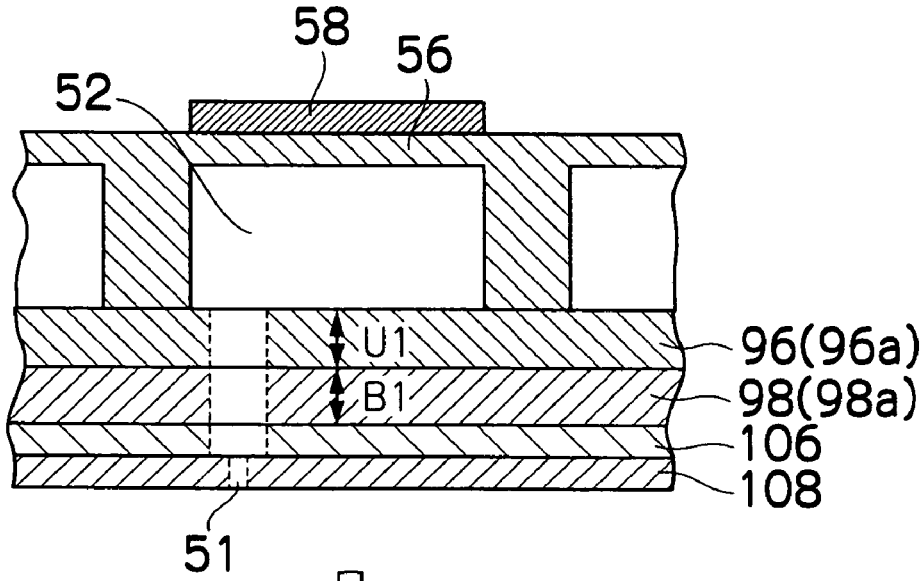
FIGS. 13A and 13B are schematic drawings showing a state where the thickness of the sensor of the lower layer has been increased with respect to the upper layer.
Figure 13B:
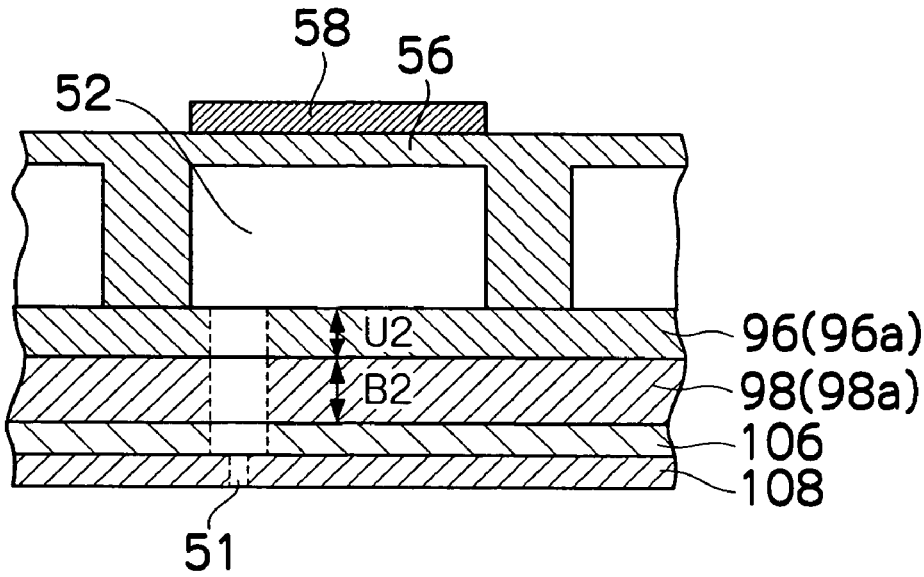

Consequently, if the thickness U1 of the pressure sensor member of the upper layer 96 and the thickness B1 of the pressure sensor member of the lower layer 98 are equal, namely, U1=B1, as shown in FIG. 13A, then the problem described above may occur. Therefore, as shown in FIG. 13B, the thickness B2 of the pressure sensor member of the lower layer 98 is made larger than the thickness U2 of the pressure sensor member of the upper layer 96, and the following relationships are satisfied: U2<B2; and B2=U2×PL.

In this way, by setting the thickness of the pressure sensor member of the lower layer 98 larger than that of the upper layer 96, and furthermore setting it to satisfy the formula (2), then it is possible to make the sensor output voltage of the upper layer 96 equal to that of the lower layer 98. Consequently, it is possible to achieve the accurate pressure determination even if the pressure sensor members are formed in two layers and the pressure sensor member of either one of two layers are used as the effective determination section.

Next, a second solution is described. According to the second solution, the sensor output voltage of the lower layer is made to be equal to that of the upper layer by making the sensitivity of the pressure sensor member of the lower layer larger than that of the upper layer.

As the method of constituting pressure sensor members having different sensitivities in this way, for example, the following method can be adopted: if piezoelectric sensors such as PVDF is used as the pressure sensors, then materials having different g constants may be used. This g constant is the constant of mechanical-electrical conversion in a piezoelectric body, indicates the ratio between the force applied to the piezoelectric body and the electric field induced by that force, and therefore shows the determination sensitivity.

In practice, in a case where the pressure sensor members of PVDF of the same thickness are used, it is possible to alter the g constant by adding another material and varying the composition ratio, for example, and thereby the sensitivity can be adjusted.

Next, a third solution is described. According to the third solution, the sensitivity of the sensor in the lower layer is increased by making the electrode surface area of the lower layer sensor (pressure sensor member) larger than the electrode surface area of the upper layer sensor (pressure sensor member).

In other words, in view of the spread of the pressure transmission range in the sensor layer of the lower layer as shown in FIG. 12, by increasing the surface area of the sensor layer of the lower layer, the output charge is increased and hence the sensor sensitivity of the lower layer is increased.

In this case, if the electrode surface area is increased, then the electrostatic capacitance of the pressure sensor member is increased, and hence the effects of the electrostatic capacitance of the wiring sections extended from the pressure sensor members can be made relatively smaller, and thereby the determination performance can be improved.

Figure 14:
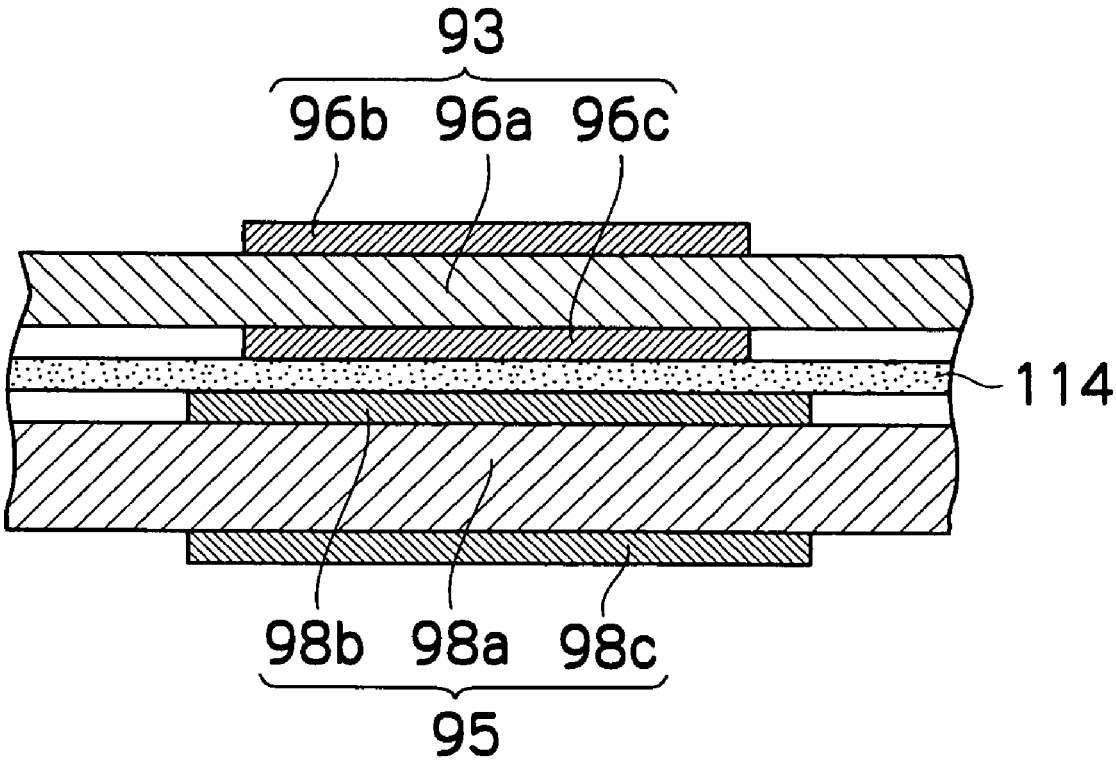
FIG. 14 is a schematic drawing showing a state where the surface area of the pressure receiving section of the lower layer has been increased with respect to the upper layer.

As shown in FIG. 14, the surface area UB of the electrodes 98*b*, 98*c* corresponding to the lower layer 98 is made greater than the surface area US of the electrodes 96*b*, 96*c* corresponding to the upper layer 96, in other words, "US<UB" is satisfied. In this case, the effective increasing amount of the surface area can be determined by analyzing the state of propagation of the pressure shown in FIG. 12, for example. If the surface area is increased by more than a necessary amount, then a region which does not contribute to pressure determination may occur and hence a reduction in the output voltage of the sensor may happen. Furthermore, a problem of the reduction in wiring space between the electrodes may also occur, and therefore, desirably, the range in which the surface area UB of the electrodes 98*b*, 98*c* corresponding to the lower layer 98 is increased is kept within the region through which the pressure is propagated, as shown in FIG. 12.

Finally, a fourth solution is described. According to the fourth solution, the effects of the upper layer is alleviated, by reducing the thickness of the sensor layer of the upper layer, or removing the sensor layer of the upper layer completely, in sections where a pressure receiving section of the sensor exists in the lower layer (namely, the sections where the electrodes which cause the sensor to function are disposed; the effective determination sections).

Figure 15:
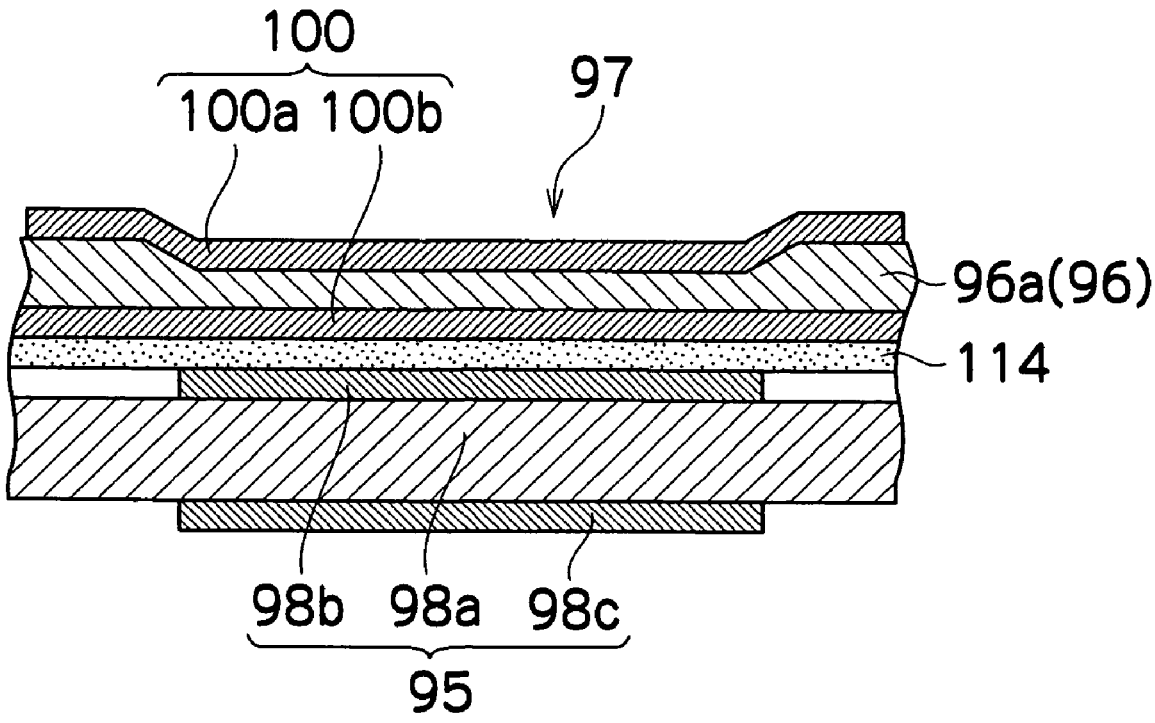
FIG. 15 is a schematic drawing showing a state where the thickness of the sensor layer of the upper layer has been reduced in a position corresponding to that of the pressure receiving section of the lower layer.

In this case, if the upper layer is removed completely, the effects of the upper layer are eliminated completely. However, removing the upper layer completely in this way makes it difficult to arrange wires extended from the electrodes of the upper layer over these sections. Therefore in this case, in order to perform wiring of the electrical wires 100*a* and 100*b* of the upper layer, a recess section 97 is provided in the PVDF 96*a* of the upper layer 96, in such a manner that the thickness of the sensor sections of the upper layer 96 is reduced and a small portion of the sensor section of the upper layer 96 remains as shown in FIG. 15.

In this way, even if the thickness of the sensor sections of the upper layer 96 is simply reduced, it is still possible to reduce the effects on the lower layer 98.

Figure 16:
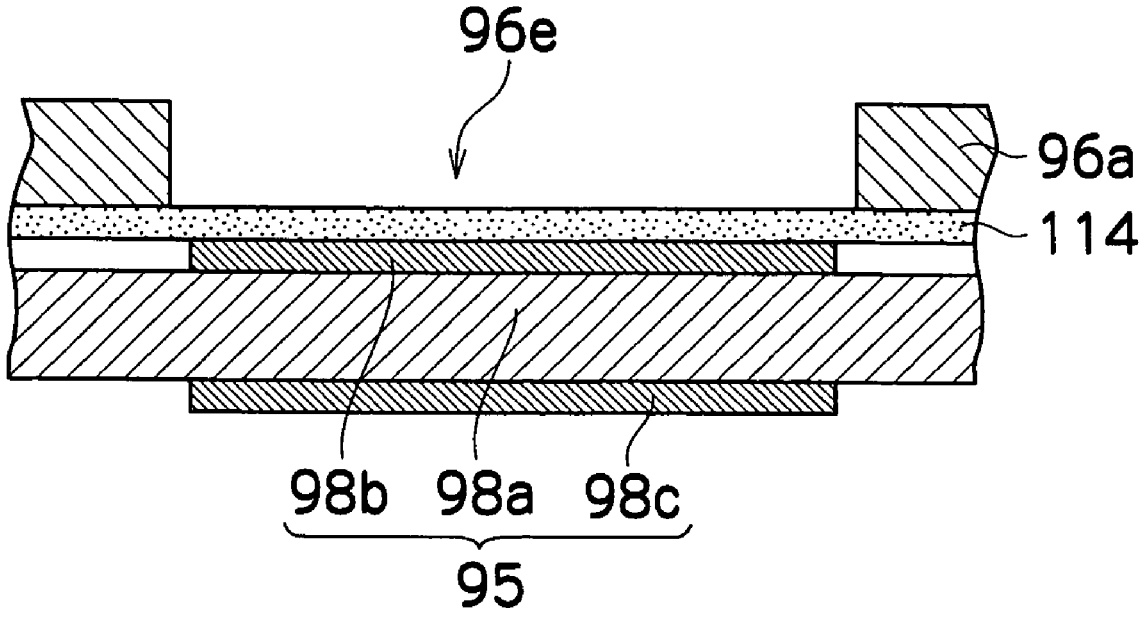
FIG. 16 is a schematic drawing showing a state where an opening has been provided in the upper sensor layer, in a position corresponding to that of the pressure receiving section of the lower layer.

Furthermore, as shown in FIG. 16, in the region where the pressure receiving section of the sensor in the lower layer 98 is located and the electrical wires of the upper layer 96 are not arranged, an opening (a vacancy section) 96*e* may be provided in the sensor layer of the upper layer 96 (PVDF 96*a*) and thereby the upper sensor layer in this region may be removed completely. By adopting this composition, it is possible to eliminate the effects of the upper layer 96, completely.

As described above, by adopting a multiple-layer sensor structure, it is possible to resolve the problem of different determination sensitivities in the upper layer and the lower layer; however, in such a multiple-layer sensor structure, the output of the lower layer becomes smaller than that of the upper layer and is subject to the effects of the upper layer.

Therefore, in order to resolve these problems, it is desirable in performance terms that the pressure receiving sections in the upper sensor layer are provided as many as possible, and the upper layer sensors are possibly used for the pressure determination, instead of the lower layer sensors.

On the other hand, as shown in FIG. 10 or 11, there is a problem that useless surface area occurs on both the upper layer 96 and the lower layer 98, on the side which is distant from the extension position of the wires connected to the connectors 104 (on the lower side in FIG. 10 and FIG. 11), because the wiring density is low on the side.

In order to resolve this problem, considering the wiring density, the electrodes corresponding to the pressure chambers 52 (the pressure receiving sections of the sensor layers) may be possibly distributed on the upper layer, rather than being distributed evenly between the upper layer and the lower layer. Thereby, it is possible to increase the number of sensors of the upper layer, which have good characteristics as a sensor, and hence it is possible to improve the pressure determination accuracy.

Figure 17:
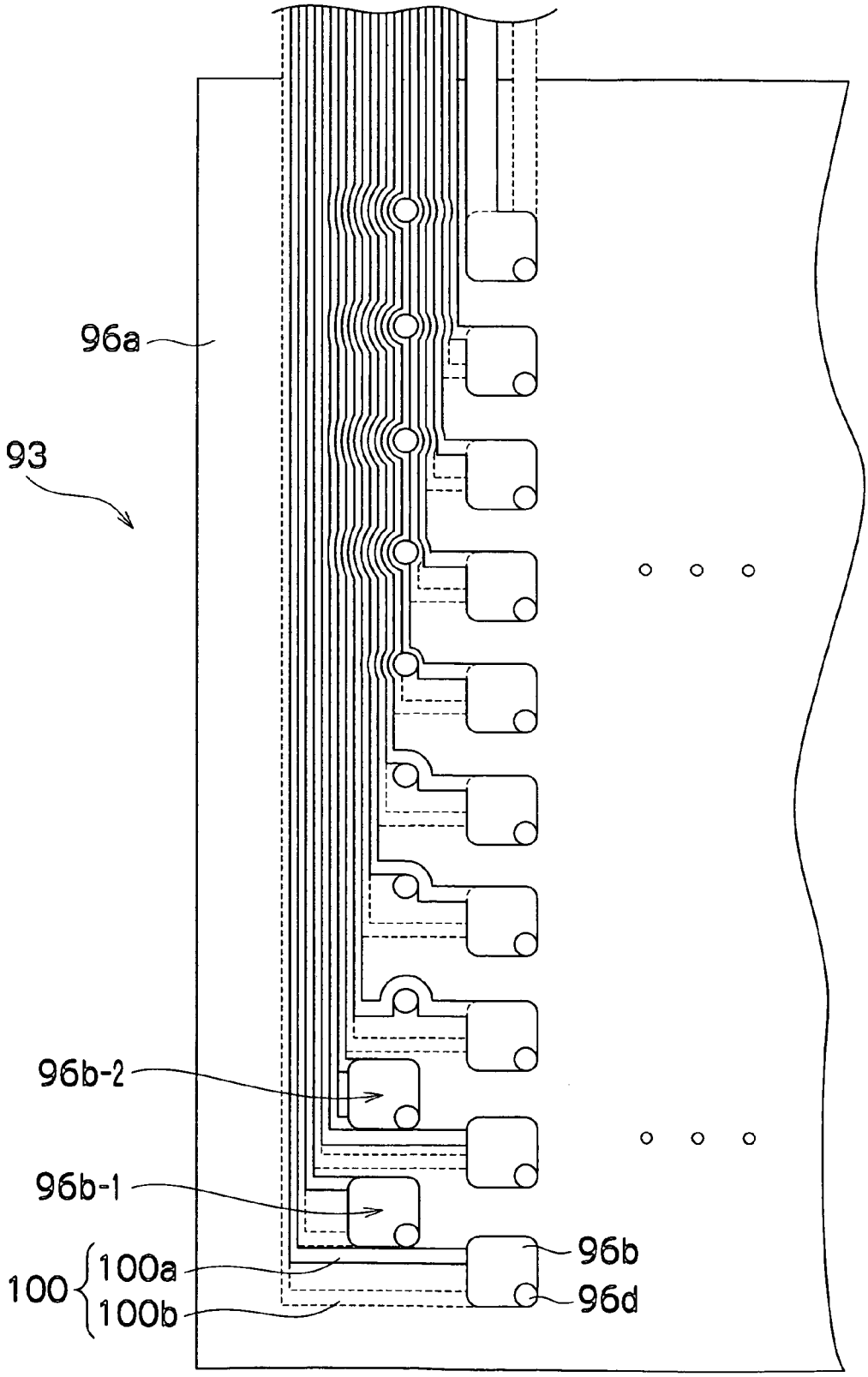
FIG. 17 is a schematic drawing showing a state where the arrangement density of the pressure receiving sections is increased in the upper layer, in the section distant from the wiring extension position.

FIG. 17 shows an example of the upper layer in a case where the sensor pressure receiving sections have been increased on the side distant from the extension positions of the wires in this way.

As shown in FIG. 17, in the upper layer 96 of the multiple-layer sensor, pressure receiving sections are arranged at high density by disposing such electrodes as electrodes 96*b*-1 and 96*b*-2 in FIG. 17 in positions where the electrodes 96*b* are not disposed in FIG. 10, for example, on the side (in other words, on the lower side in FIG. 17) that is distant from the extension positions of the wires (from the positions where the wires are connected to the connectors 104 in FIG. 10; the upper side in FIG. 17). Furthermore, in the vicinities of the wiring extension positions on the upper side of the drawing, a certain degree of the surface area occupied by the electrical wires 100 is needed and therefore the pressure receiving sections (electrodes 96*b*) are arranged at low density. Furthermore, in the intermediate region, the pressure receiving sections are arranged at the medium density.

As a result, in the upper layer 96 of the multiple-layer sensor, on the side near to the wiring extension positions (on the side where the wires are connected to the connectors 104), the wires from the pressure receiving sections on the side distant from the wiring extension position and the wires from the pressure receiving sections on the side near to the wiring extension position, in addition to the pressure receiving sections themselves, are disposed.

On the other hand, although not shown in the drawings, in the lower layer, hardly any pressure receiving sections are disposed on the side distant from the wiring extension positions, and the pressure receiving sections are disposed at a low density on the side near to the wiring extension position, and the pressure receiving sections are disposed at the medium density in the intermediate region.

By combining all of the pressure receiving sections of the upper layer and the lower layer arranged in this fashion, an arrangement is achieved in which one pressure receiving section is provided for each one of the pressure chambers.

Furthermore, if these electrodes are not disposed at the positions where the electrodes 96*b*-1 and 96*b*-2 are provided on the lower side in FIG. 17, and by providing electrodes on the lower layer in these positions, the pressure sensor member of the lower layer is used as the effective determination sections, then openings 96*e* such as that shown in FIG. 16 can be provided in the upper layer 96. Furthermore, if the method of arranging pressure receiving sections shown in FIG. 17 is combined with the various solutions described above for resolving the problems of the different determination sensitivity between the upper layer and the lower layer, then particularly beneficial results can be achieved.

Furthermore, rather than limiting the multiple layer sensor to a two-layer sensor as shown above, it is also possible to adopt three or more layers. In this case, the number of layers required to provide pressure receiving sections of all of the pressure chambers may be calculated and designed on the basis of the density of the pressure receiving sections, the wiring pitch, the distance to the wiring extension sections, the dimensions of the flow channels to the ejection nozzles, and/or the like.

Furthermore, the wires are not limited to being extended to one edge of the sensor sheet, and more efficient wiring is possible if the wires are extended to the edges to which design allows the wires to be extended.

In the foregoing description, according to the present embodiment, the pressure sensor member, which is composed in a single layer in the related art, has a two-layer structure (or a multiple-layer structure of three or more layers, depending on the sensor arrangement density required); sensors are positioned in every other column in the main scanning direction (lengthwise direction of the head) (or in the case of n sensor layers, every (n−1) columns); spaces are provided between the sensor columns which are arrayed in the sub-scanning direction (breadthways direction of the head); and the wires are arranged over these space regions, thereby making it possible to achieve a high density arrangement of the sensors, while the sensors are also arranged at a practicable wiring pitch.

Furthermore, as described above, by making the sensor layer (pressure sensor member) of the lower layer thicker than the sensor layer (pressure sensor member) of the upper layer; by using a piezoelectric material having a high g constant as the pressure sensor member of the lower layer; or providing openings or making the sensor layer of the wiring sections of the upper layer thinner, correspondingly to the regions of the lower layer where the sensor sections (effective determination sections) are located, then it is possible to ensure that the same voltage is output by the sensor layer of the upper layer and the sensor layer of the lower layer when the same pressure is input to the sensors. Alternatively, it is possible to reduce the difference between the output voltage from the upper layer and the output voltage from the lower layer.

Furthermore, by forming the sensor layer of the lower layer with a larger electrode surface area than that of the upper layer, it is possible to increase the output charge. Moreover, if the electrode surface area is increased, then the electrostatic capacitance of the sensor rises, and hence the effects of the electrostatic capacitance of the wiring sections from sensors can be kept relatively small, and the determination performance can be improved.

Furthermore, as described above, by disposing the pressure receiving sections at a high density on the side distant from the wiring extension positions of the upper layer of the multiple-layer sensor; by disposing the pressure receiving sections at a low density on the side near to the wiring extension positions of the upper layer; by disposing few pressure receiving sections on the side distant from the wiring extension positions of the lower layer; or by disposing pressure receiving sections at low density on the side near to the wiring extension positions of the lower layer, then it is possible to increase the number of the sensors of the upper layer, where the sensor characteristics are favorable.

Next, a second embodiment of the present invention is described.

The second embodiment is devised in order to suppress cross-talk which may occur when the pressure chambers, pressure sensors and electrical wires extended from the pressure sensors are arranged at high density as in the first embodiment described above.

The general composition of the inkjet recording apparatus comprising the liquid ejection apparatus according to the present embodiment is basically the same as the first embodiment shown in FIGS. 1 to 5. The parts of the composition of this apparatus which are different from those in the first embodiment are described below, and constituent elements which are the same as the first embodiment are labeled with the same reference numerals and detailed description thereof is omitted here.

Figure 18:
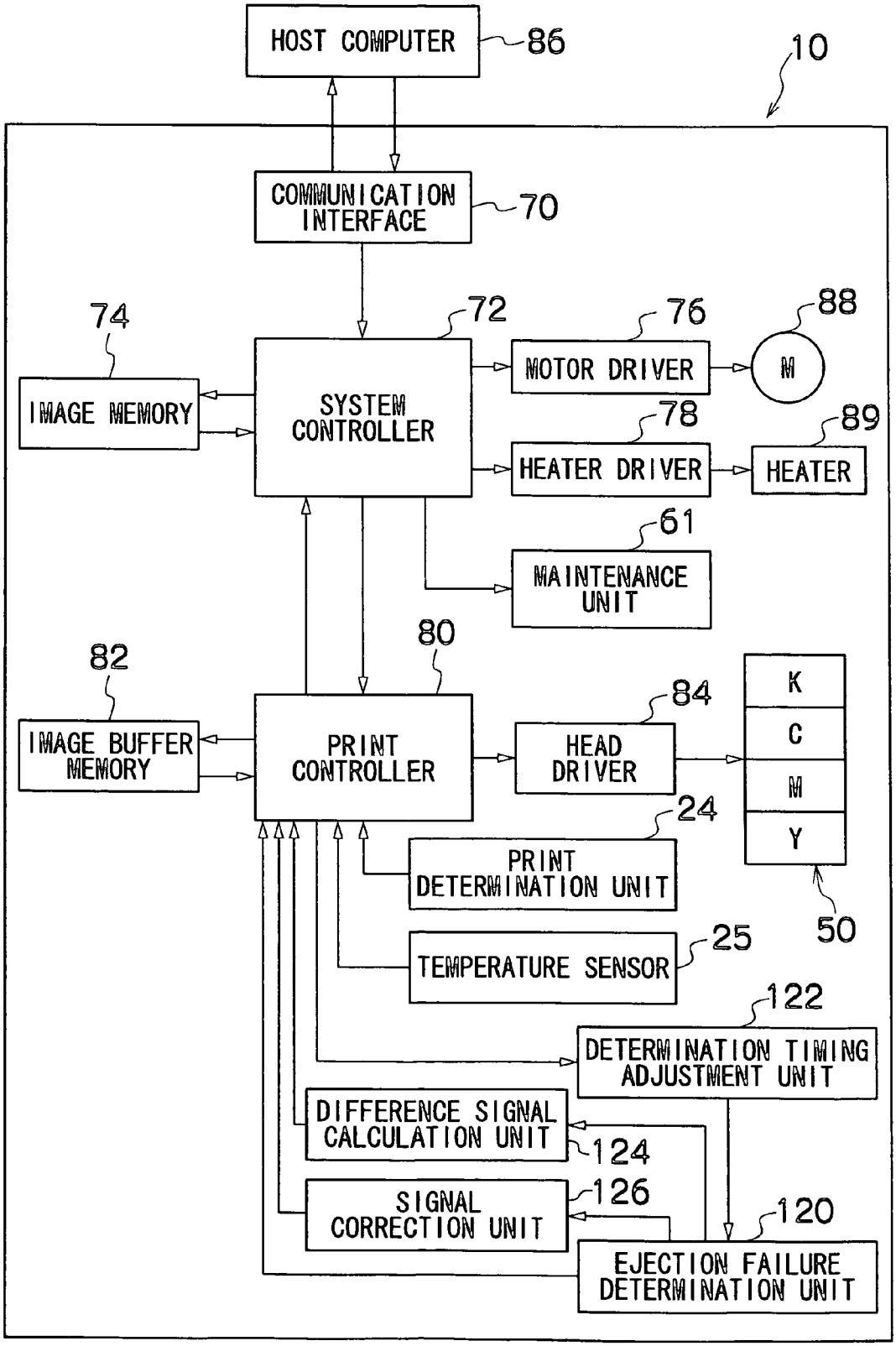
FIG. 18 shows graphs of a case where the signal difference is found without taking account of the delay or difference in amplitude between the cross-talk signal from the positive electrode and the cross-talk signal from the negative electrode.

FIG. 18 shows a block diagram of the main parts of the system composition of the inkjet recording apparatus 110 relating to the second embodiment.

As shown in FIG. 18, the inkjet recording apparatus 110 in the present embodiment comprises an ejection failure determination unit 120, which forms a device for determining the ejection state, such as ejection defects caused by infiltration of air bubbles, evaporation of the solvent, or the like. A pressure sensor which determines ejection defects by determining the ink pressure inside the pressure chambers 52 of the print head 50 is provided as the ejection failure determination unit 120. The pressure sensor members forming the pressure sensors are positioned in two layers with respect to each of the pressure chambers 52, and electrical wires are formed in such a manner that only one of the pressure sensor members functions as a pressure sensor with respect to each pressure chamber 52.

Furthermore, the ejection failure determination unit 120 is also connected with a determination timing adjustment unit 122 which adjusts the determination timings of the pressure sensors, a difference signal calculation unit 124 which calculates the difference in the determination signals, and a signal correction unit 126 which corrects the determination signals. These elements are described in more detail below.

The other system components are similar to those of the first embodiment described in FIG. 6, and hence detailed description thereof is omitted here.

Furthermore, the composition of the print head 50 in the inkjet recording apparatus 110 according to the present embodiment is similar to that according to the first embodiment shown in FIG. 7 to FIG. 9. Furthermore, the pressure sensor members according to the present embodiment are formed in two layers, the upper layer pressure sensor is the same as the upper layer pressure sensor 93 in the first embodiment as shown in FIG. 10, and the lower layer pressure sensor is the same as the lower layer pressure sensor 95 in the first embodiment as shown in FIG. 11.

By forming the pressure sensor members in a multiple-layer structure in this way (here, in a two-layer structure), the problem of wiring density is improved; however, due to the multiple-layer structure of the pressure sensor members, the determination section electrodes of one layer are disposed in a perpendicular direction with respect to the wiring sections of the other layer, as shown in FIG. 10 and FIG. 11. Hence a problem may arise in that a cross-talk signal may generate when the pressure is determined, because capacitance is created between the determination sections and the wires.

Due to the wiring structure, this problematic cross-talk signal is produced in the same phase in the positive and negative wires on the side receiving the effects of cross-talk. Furthermore, there is a slight variation in the amplitude of the voltage, depending on the difference between the distances (thicknesses) of the determination sections and the wires, and the amplitude is approximately proportional to the thicknesses.

Various methods for resolving the problem of the occurrence of the cross-talk have been conceived, and some of them are described below.

The first solution of this problem involves finding the difference between the signals from the positive and negative electrodes of the sensor wires, and thus canceling out the cross-talk component.

For example, the difference signal calculation unit 124 finds the difference between the cross-talk signal A of the positive electrical wire 100*a* extended from the electrodes 96*b* and 96*c* of the upper layer pressure sensor 93 shown in FIG. 10, and the cross-talk signal B of the negative electrical wire 100*b*, and thereby obtains the difference "A−B". Here, the original signals generated in the positive and negative electrodes have opposite polarity to each other, and therefore, it is simply doubled in magnitude by calculating the difference between them. In other words, the following relationship is satisfied: $S-(-S)=2S$.

Figure 19:
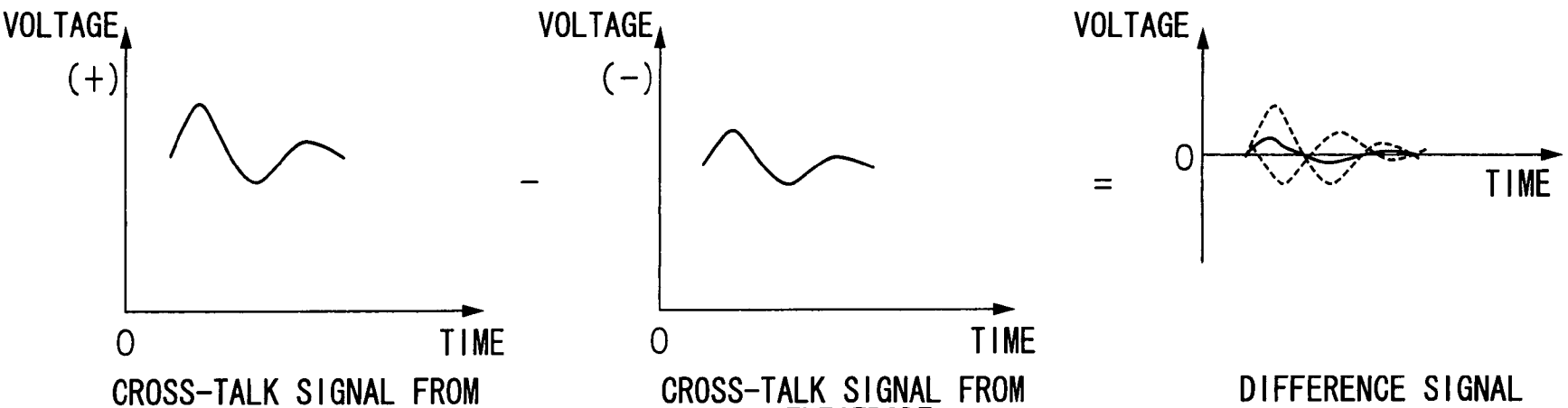

FIG. 19 is a graph showing a case where the difference, A−B, is found, with disregard to the signal delay and the difference in amplitude between the cross-talk signal A from the positive electrode and the cross-talk signal B from the negative electrode.

However, in this case, the cross-talk signals in the positive and negative wires have slightly different voltage amplitude values. In order to achieve the same voltage amplitude of the cross-talk signals, it is preferable that the difference signal calculation unit 124 alter the amplification rates between the positive and negative wire (electrodes) signals, in such a manner that they have the same voltage amplitude corresponding to the cross-talk component before calculating the difference.

Moreover, since the timing of the cross-talk is slightly delayed when the distance is distant from the pressure chamber 52, the difference signal calculation unit 124 preferably delays the signal of the electrode (the electrode 96*b* in the above example) on the side nearer to the pressure chamber 52, by approximately the same amount as the signal of the electrode on the side distant from the pressure chamber 52, in finding the difference. Here, the original signal is also delayed and amplified, but in practice, the original signal, in addition to the cross-talk signal, on the side distant from the pressure chamber also has a smaller output and suffers a time delay. Therefore, a more desirable signal is obtained by delaying and amplifying the original signal along with the cross-talk signal.

Figure 20:
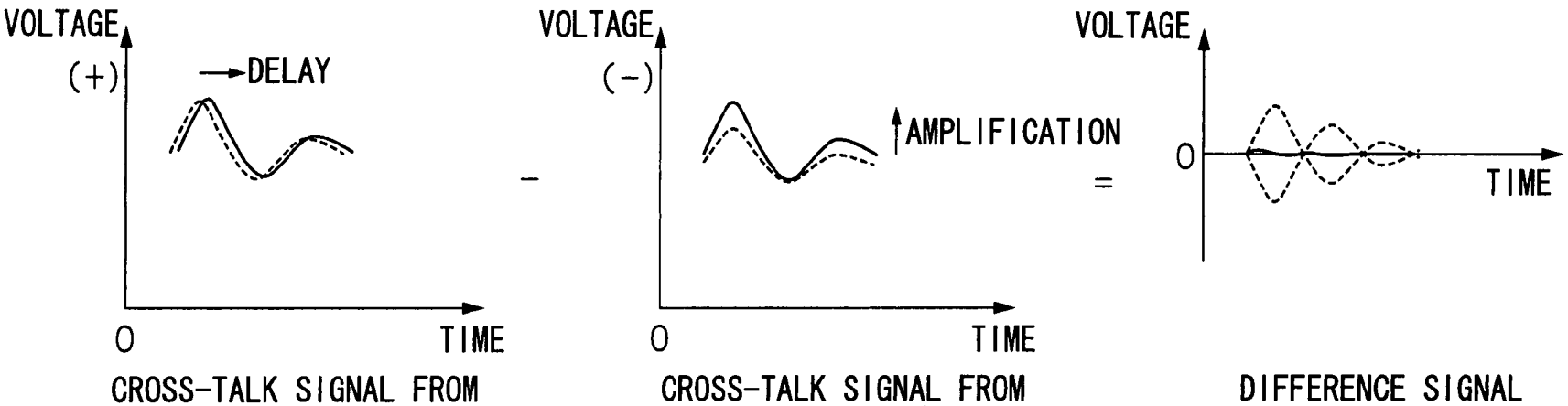
FIG. 20 shows graphs of a case where the signal difference is found while taking account of the delay or difference in amplitude between the cross-talk signal from the positive electrode and the cross-talk signal from the negative electrode.

FIG. 20 is a graph showing the difference "A–B" which is found when the signal delay and the difference in amplitude between the cross-talk signal A of the positive electrode and the cross-talk signal B of the negative electrode are taken into account.

Furthermore, since the magnitude of the signal output varies according to the depth direction of the sensor, the width of the wiring is also changed according to the depth at which it is positioned. For example, the width of the wiring on the side distant from the source of cross-talk can be increased, and the width of the wiring on the side near to the source of cross-talk can be reduced. In this case, by equalize the amounts of the electrical charges on the positive and negative sides which occur due to cross-talk and then finding the difference between them, it is possible to reliably cancel out the cross-talk component.

Next, a second solution of cross-talk is described. The second solution of cross-talk involves preventing the occurrence of cross-talk by staggering the measurement timings, in other words, by staggering the drive timings of the measurement actuators, in such a manner that pressure determination is not carried out simultaneously in mutually adjacent sensor columns, which may be a cause of cross-talk.

In a case where a two-layer structure is adopted for the pressure sensor members 94, as described above, since the mutually adjacent sensor columns are distributed among the upper layer 96 and the lower layer 98, it is desirable to adjust the determination timing by means of the determination timing adjustment unit 122 in such a manner that the determination is performed alternately by the sensors of the upper layer 96 and the sensors of the lower layer 98, for example.

Next, a third solution of cross-talk is described. In this third solution of cross-talk, considering the positive or negative electrode signals in isolation, the number of sensors causing cross-talk increases if the pressure is determined simultaneously by the sensors in each column. Therefore, by slightly staggering the pressure determination timings of the individual sensors in order to achieve the above-mentioned cross-talk signal, the effects of the cross-talk can be of a negligible level.

In this case, as a consequence, a composition is adopted in which the pressure is not determined simultaneously by a large number of sensors. Furthermore, since each pressure determination signal has the waveform in the form of an attenuating sinusoidal wave, the phases of these very small signals which have slightly staggered timings are displaced with respect to each other by ½ of the cycle, and therefore the amplitude of the waveform of the combined cross-talk signals gets smaller. This cycle is equivalent to the cycle of the resonance frequency of the pressure chambers 52.

Therefore, the determination timing adjustment unit 122 adjusts the determination timing in such a manner that the drive timings of actuators arranged along the wiring of one pressure sensor are staggered respectively by ½ of the resonance cycle of the pressure chambers.

Figure 21A:
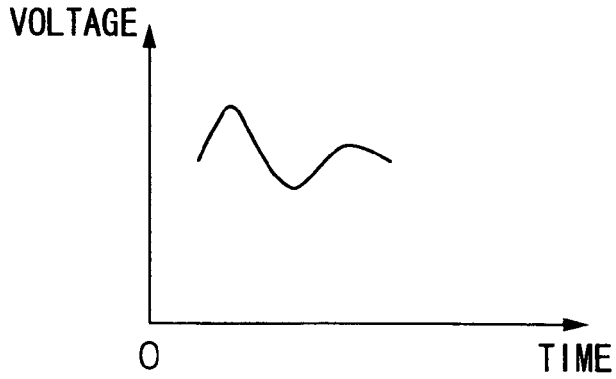
FIGS. 21A and 21B are graphs showing a cross-talk signal in a case where the drive timings of the pressure chambers are staggered by ½ of the resonance cycle of the pressure chambers, FIG. 21A showing the cross-talk signal from one pressure chamber, and FIG. 21B showing the combined cross-talk signals from four pressure chambers, respectively staggered in phase by ½ a cycle.
Figure 21B:
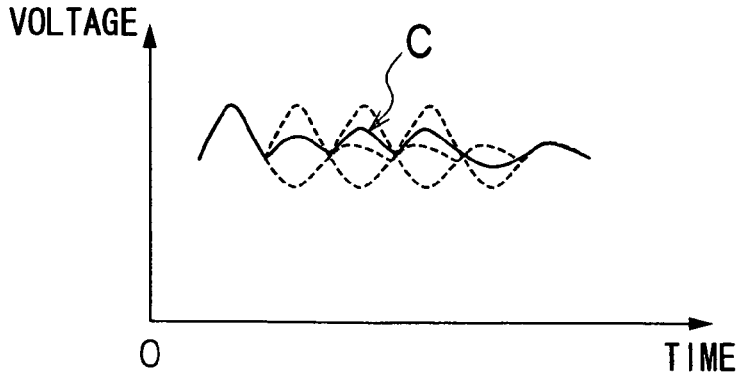

FIGS. 21A and 21B show graphs of a cross-talk signal obtained in a state where the drive timings of the pressure chambers 52 are respectively staggered by ½ of the resonance cycle of the pressure chambers 52.

FIG. 21A shows a cross-talk signal from one pressure chamber 52; and FIG. 21B shows the state where the cross-talk signals are combined, the cross-talk signals being obtained from four pressure chambers 52 and respectively staggered in phase by ½ of the cycle. As shown by the region indicated by the reference numeral C in FIG. 21B, the amplitude is lower in the region where a plurality of signals are mutually combined.

Next, a fourth solution of cross-talk is described. In this fourth solution of cross-talk, there is a correlation between the determination signal by a sensor which gives the cross-talk and the cross-talk signal on the side receiving the cross-talk, and therefore the correlation between these signals is measured (or deduced theoretically) in advance, and then in the actual determination process, the amount of cross-talk is estimated on the basis of the determination signal by the sensor on the side applying cross-talk, and the cross-talk signal on the side receiving the cross-talk is cancelled out accordingly.

When this fourth solution is carried out in practice, the signal correction unit 126 may cancel out the cross-talk signal by means of a software calculation, or alternatively, the signal correction unit 126 may be constructed as a hardware unit using an electrical circuit, such as an operating amplifier, in such a manner that the cross-talk signal can be cancelled out by this circuit.

Next, a fifth solution of the cross-talk is described. This fifth solution of cross-talk involves providing an electrical shielding layer (connected to ground) between the layers, such as the upper layer 96 and the lower layer 98, and thus the electric fields are isolated and the effects of cross-talk are reduced.

In this case, since the thickness of the insulating layer between the shielding layer and each sensor electrode and the thickness of the shielding layer exist, the thickness of the overall sensor layer becomes slightly larger and can increases by around 15 μm, for example.

Finally, a sixth solution of the cross-talk is described. In this sixth solution of cross-talk, the wires of the upper layer pressure sensor 93 are arranged so as to avoid the effective determination sections (pressure receiving sections) of the lower layer pressure sensor 95, and the wires of the lower layer pressure sensor 95 are arranged so as to avoid the effective determination sections (pressure receiving sections) of the upper layer pressure sensor 93. In this way, the effects of cross-talk are reduced.

This method is particularly suitable to the pressure chambers on the side distant from the end where the wires are extended.

In the foregoing description, according to the present embodiment, the pressure sensor members, which are composed by a single layer in the related art, have a two-layer structure (or a multiple-layer structure of three or more layers, depending on the sensor arrangement density required), and furthermore, the sensors (effective determination sections) are positioned in every other column in the main scanning direction (lengthwise direction of the head) (or if the pressure sensor members have n layers, then every (n−1) columns), thus providing spaces between the sensor columns which are arrayed in the sub-scanning direction (breadthways direction of the head), and the wires are arranged in these space regions, thereby making it possible to achieve a high-density arrangement of sensors while the sensors are arranged at a practicable wiring pitch.

Furthermore, in the case of a multiple-layer sensor structure, by finding the difference between the signals in the sensor wires from the positive and negative electrodes and canceling out the signal component generated by the cross-talk, it is possible to reduce the effects of the cross-talk.

Moreover, in this case, the difference may be obtained after altering the amplification rates of the signals in the positive and negative wires in such a manner that the voltage amplitude corresponding to the cross-talk components is the same; or after temporally delaying the signal from the electrode on the side nearer to the pressure chamber. Furthermore, the difference may be also obtained by altering the width of the wires in accordance with their positions in the depth direction. In these cases, it is possible to reliably cancel out the signal caused by the cross-talk in obtaining the difference.

Furthermore, by staggering the measurement timings (measurement actuator drive timings) in such a manner that mutually adjacent sensor columns (sensors columns which are the source of cross-talk) do not perform pressure determination simultaneously, then it is possible to suppress the effects of the cross-talk.

Moreover, by performing the pressure determination in a state where the actuator drive timings of the sensors which are the source of cross-talk are respectively staggered by ½ of the resonance cycle of the pressure chambers, then the cross-talk signals cancel each other out and the effects of cross-talk can be suppressed.

Furthermore, it is possible to suppress the effects of cross-talk by previously measuring (or theoretically deducing) the correlation between the determination signal by the sensor on the side applying cross-talk and the cross-talk signal by the sensor on the side receiving the cross-talk, estimating the amount of the cross-talk on the basis of the determination signal by the sensor on the side applying cross-talk during the pressure determination process, and then performing the cancellation (correction) with respect to the amount of cross-talk signal on the side receiving the cross-talk.

Moreover, the effects of cross-talk can be suppressed by providing an electrical shield layer between the upper layer and the lower layer, for example.

Furthermore, the effects of cross-talk can also be suppressed by arranging the wires of the upper layer in such a manner that they avoid the pressure receiving sections of the lower layer, and arranging the wires of the lower layer in such a manner that they avoid the pressure receiving sections of the upper layer.

The liquid ejection head and the liquid ejection apparatus according to the present invention have been described in detail above, but the present invention is not limited to the aforementioned embodiments. It is of course possible for improvements or modifications of various kinds to be implemented, within a range which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head having nozzles for ejecting liquid in which a plurality of pressure chambers are arranged in a two-dimensional matrix configuration, the liquid ejection head comprising:

pressure generating devices which are disposed so as to correspond to the pressure chambers and generate pressure for ejecting the liquid in the pressure chambers;

pressure sensor members formed in at least two layers which determine the pressure inside the pressure chambers generated by the pressure generating devices; and electrodes which are disposed on both surfaces of one of the layers of the pressure sensor members and cause the one of the pressure sensor members to become effective determination sections.

2. The liquid ejection head as defined in claim 1, wherein:

the number of the layers of the pressure sensor members is n, where n represents a positive integer;

the effective determination sections of one of the pressure sensor members are provided at every (n−1) positions, in respect of at least one of rows and columns of the pressure chambers arranged in a two-dimensional matrix configuration; and electrical wires extended from the electrodes of the effective determination sections are arranged in at least one part of regions where the effective determination sections are not provided.

3. The liquid ejection head as defined in claim 1, wherein sensitivity of the pressure sensor member which is relatively distant from the pressure chambers is greater than sensitivity of the pressure sensor member which is relatively near to the pressure chambers.

4. The liquid ejection head as defined in claim 3, wherein thickness of the pressure sensor member which is relatively distant from the pressure chambers is greater than thickness of the pressure sensor member which is relatively near to the pressure chambers.

5. The liquid ejection head as defined in claim 3, wherein a g-constant of the pressure sensor member which is relatively distant from the pressure chambers is greater than a g-constant of the pressure sensor member which is relatively near to the pressure chambers.

6. The liquid ejection head as defined in claim 1, wherein thickness of close regions of the pressure sensor member relatively near to the pressure chambers which correspond to the effective determination sections of the pressure sensor member relatively distant from the pressure chambers, is smaller than thickness of a periphery of the close regions of the pressure sensor member relatively near to the pressure chambers.

7. The liquid ejection head as defined in claim 1, wherein close regions of the pressure sensor member relatively near to the pressure chambers which correspond to the effective determination sections of the pressure sensor member relatively distant from the pressure chambers, are vacant.

8. The liquid ejection head as defined in claim 1, wherein:

the pressure sensor members are made of piezoelectric material; and electrode surface area of the pressure sensor member which is relatively distant from the pressure chambers is greater than electrode surface area of the pressure sensor member which is relatively near to the pressure chambers.

9. The liquid ejection head as defined in claim 1, wherein, in the pressure sensor member which is relatively near to the pressure chambers, the effective determination sections are arranged at relatively high density on a side relatively distant from a position where a wire is extended to an outside, and the effective determination sections are arranged at relatively low density on a side relatively near to the position where the wire is extended to the outside.

10. The liquid ejection head as defined in claim 9, wherein, in the pressure sensor member which is relatively distant from the pressure chambers, density of the effective determination sections on a side relatively distant from a position where a wire is extended outward is smaller than density of the effective determination sections on a side relatively near to the position where the wire is extended outward.

11. A liquid ejection apparatus having a liquid ejection head having nozzles for ejecting liquid in which a plurality of pressure chambers are arranged in a two-dimensional matrix configuration, the liquid ejection head comprising:

pressure generating devices which are disposed so as to correspond to the pressure chambers and generate pressure for ejecting the liquid in the pressure chambers;

pressure sensor members formed in at least two layers which determine the pressure inside the pressure chambers generated by the pressure generating devices; and electrodes which are disposed on both surfaces of one of the layers of the pressure sensor members and cause the one of the pressure sensor members to become effective determination sections.

12. The liquid ejection apparatus as defined in claim 11, wherein:

the number of the layers of the pressure sensor members is n, where n represents a positive integer;

the effective determination sections of one of the pressure sensor members are provided at every (n−1) positions, in respect of at least one of rows and columns of the pressure chambers arranged in a two-dimensional matrix configuration; and electrical wires extended from the electrodes of the effective determination sections are arranged in at least one part of regions where the effective determination sections are not provided.

13. The liquid ejection apparatus as defined in claim 11, further comprising a difference signal calculation device which gets a difference between signals from a positive electrode and a negative electrode of the electrodes through electrical wires, wherein the difference signal calculation device obtains the difference according to at least any one of the following (i) to (iii):

(i) an amplification rate of the signal from the positive electrode is made to be different from an amplification rate of the signal from the negative electrode;

(ii) the signal from the electrode relatively near to the pressure chambers is temporally delayed; and (iii) width of the electrical wires is altered in accordance with its position in a depth direction.

14. The liquid ejection apparatus as defined in claim 11, further comprising a determination timing adjustment device which staggers determination timings in such a manner that determination of the pressure is not carried out simultaneously with respect to columns of the pressure sensor members, the columns being mutually adjacent in a direction in which electrical wires are extended from the electrodes of the pressure sensor members.

15. The liquid ejection apparatus as defined in claim 14, wherein the determination timing adjustment device staggers the determination timings of the pressure sensor members arranged in the direction of the electrical wires, by ½ of a resonance cycle of the pressure chambers.

16. The liquid ejection apparatus as defined in claim 11, further comprising a signal correction device which: measures or logically calculates a correlation between a signal determined by the pressure sensor member which applies cross-talk, and a cross-talk signal by the pressure sensor member which receives the cross-talk; and corrects a signal based on the pressure sensor members according to the cross-talk signal by the pressure sensor member which receives the cross-talk, in determining pressure determination.

17. The liquid ejection apparatus as defined in claim 11, further comprising an electrical shielding layer provided between the layers of the pressure sensor members.

* * * * *